US009243422B2

(12) United States Patent
Hunt et al.

(10) Patent No.: US 9,243,422 B2
(45) Date of Patent: Jan. 26, 2016

(54) FRAME AND ROOF SYSTEM FOR A PORTABLE SHELTER

(71) Applicant: Sunjoy Industries Group Ltd., Steubenville, OH (US)

(72) Inventors: David Lewis Hunt, Cincinnati, OH (US); Gilbert Carl Schmidt, Walton, KY (US); Sean Michael Banal, Galena, OH (US); Lianzhang Pan, Huzhou (CN)

(73) Assignee: Sunjoy Industries Group Ltd., Steubenville, OH (US)

( * ) Notice: Subject to any disclaimer, the term of this patent is extended or adjusted under 35 U.S.C. 154(b) by 0 days.

(21) Appl. No.: 14/091,644

(22) Filed: Nov. 27, 2013

(65) Prior Publication Data

US 2015/0144170 A1 May 28, 2015

(51) Int. Cl.
*E04H 15/34* (2006.01)
*E04H 15/18* (2006.01)

(52) U.S. Cl.
CPC ..... *E04H 15/34* (2013.01); *E04H 15/18* (2013.01)

(58) Field of Classification Search
CPC ..... E04H 15/32; E04H 15/34; E04H 15/44; E04H 14/48; E04H 1/12; E04H 1/1205; E04B 7/00; E04B 7/16
USPC ..... 135/121, 122, 147, 157–159, 905; 52/63, 82, 91.1, 92.1, 93.1, 79.12; D25/56, 16
See application file for complete search history.

(56) References Cited

U.S. PATENT DOCUMENTS

| | | | | | |
|---|---|---|---|---|---|
| 1,958,296 | A | * | 5/1934 | Crow | 135/122 |
| 2,265,479 | A | | 12/1941 | Goodman | |
| 2,836,860 | A | * | 6/1958 | Staropoli | 52/32 |
| 3,333,373 | A | | 8/1967 | Taylor et al. | |
| 3,952,463 | A | | 4/1976 | Lane | |
| 4,066,089 | A | | 1/1978 | Rainwater | |

(Continued)

FOREIGN PATENT DOCUMENTS

| | | | | |
|---|---|---|---|---|
| JP | 2002138713 A | * | 5/2002 | E04H 15/44 |
| WO | WO 9827296 A1 | * | 6/1998 | E04H 15/58 |

OTHER PUBLICATIONS

Use and Care Guide for Lansing Gazebo, Hampton Bay, manufactured by Sunjoy Industries, pp. 1-9, dated Oct. 2002.

(Continued)

*Primary Examiner* — Winnie Yip
(74) *Attorney, Agent, or Firm* — The Law Office of Patrick F. O'Reilly III, LLC

(57) ABSTRACT

A portable shelter framing system is disclosed herein. The portable shelter framing system includes a plurality of vertical support members; a plurality of crossbeam members, each of the crossbeam members configured to be connected between a pair of the plurality of vertical support members without the use of tools; and a plurality of roof frame members, each of the roof frame members configured to be coupled to one of the plurality of vertical support members or one of the plurality of crossbeam members without the use of tools. In one or more embodiments, the portable shelter framing system further includes a plurality of connecting members, each of the connecting members configured to couple a respective one of the plurality of roof frame members to a respective one of the plurality of vertical support members or to a respective one of the plurality of crossbeam members without the use of tools.

20 Claims, 18 Drawing Sheets

(56) References Cited

U.S. PATENT DOCUMENTS

| | | | | | |
|---|---|---|---|---|---|
| 4,229,915 | A | | 10/1980 | Snow et al. | |
| 4,558,713 | A | | 12/1985 | Hagler et al. | |
| 4,726,153 | A | | 2/1988 | Adler et al. | |
| 4,733,508 | A | | 3/1988 | Greenblatt | |
| 4,914,768 | A | | 4/1990 | Howard | |
| 4,948,289 | A | * | 8/1990 | Dellinger | 403/246 |
| 5,115,828 | A | * | 5/1992 | Spaulding | 135/142 |
| 5,226,440 | A | | 7/1993 | Fuhrman | |
| 5,335,685 | A | * | 8/1994 | Dahulich | 135/156 |
| 5,511,572 | A | | 4/1996 | Carter | |
| 5,579,796 | A | | 12/1996 | Mallo et al. | |
| 5,632,293 | A | | 5/1997 | Carter | |
| 5,661,942 | A | | 9/1997 | Palmer | |
| 5,779,386 | A | | 7/1998 | Eichhorn | |
| 6,089,247 | A | * | 7/2000 | Price | 135/145 |
| 6,173,726 | B1 | | 1/2001 | Talmadge | |
| 6,200,060 | B1 | | 3/2001 | Vernay | |
| 6,206,020 | B1 | | 3/2001 | Lynch | |
| 6,216,717 | B1 | | 4/2001 | Chen | |
| 6,283,136 | B1 | * | 9/2001 | Chen | 135/144 |
| 6,651,685 | B2 | | 11/2003 | Connelly et al. | |
| 6,745,521 | B1 | * | 6/2004 | Klemming | 52/79.6 |
| 6,761,181 | B1 | | 7/2004 | Tseng | |
| 6,772,780 | B2 | | 8/2004 | Price | |
| 6,814,094 | B1 | | 11/2004 | Barber | |
| 6,820,629 | B2 | | 11/2004 | Tseng | |
| 6,923,195 | B2 | | 8/2005 | Tseng | |
| 7,025,074 | B2 | | 4/2006 | Porter | |
| 7,207,344 | B2 | * | 4/2007 | Wu | 135/158 |
| 7,219,681 | B1 | | 5/2007 | Hamilton-Jones | |
| 7,451,776 | B2 | | 11/2008 | Chen | |
| 7,703,469 | B2 | | 4/2010 | Danziger | |
| 7,814,723 | B2 | | 10/2010 | VanElverdinghe | |
| 7,921,864 | B2 | | 4/2011 | Carter | |
| 8,001,986 | B2 | | 8/2011 | Shumate | |
| 8,082,938 | B2 | | 12/2011 | Prusmack | |
| 2006/0266401 | A1 | | 11/2006 | Wu | |
| 2007/0215191 | A1 | * | 9/2007 | Huang et al. | 135/131 |
| 2009/0314323 | A1 | * | 12/2009 | Park et al. | 135/145 |
| 2010/0275962 | A1 | * | 11/2010 | Park et al. | 135/122 |
| 2011/0308559 | A1 | | 12/2011 | Ma et al. | |
| 2012/0240970 | A1 | | 9/2012 | Parsons et al. | |

OTHER PUBLICATIONS

Owner's Manual for Bay Window Gazebo, Garden Oasis Living Outdoors, manufactured by Sunjoy Industries, pp. 1-9, dated Oct. 2006.

11' x 13' South Hampton Gazebo Instruction Manual, manufactured by Sunjoy Industries, pp. 1-8, dated Oct. 2004.

11' x 13' New Port Gazebo Instruction Manual, manufactured by Sunjoy Industries, pp. 1-7, dated Oct. 2012.

* cited by examiner

Detail "A"

Detail "B"

Detail "C"

FRAME AND ROOF SYSTEM FOR A PORTABLE SHELTER

CROSS-REFERENCE TO RELATED APPLICATIONS

Not Applicable.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to portable shelter framing systems. More particularly, the invention relates to portable shelter framing systems that are configured to be assembled without the use of tools.

2. Background and Description of Related Art

Portable shelters, such as outdoor gazebos, are useful for a myriad of different applications. For example, portable gazebos are often used for outdoor parties, such as backyard cookouts or tailgate parties at various sporting events. Because the portable gazebos are at least partially enclosed, a food serving table or tables are often placed inside of the gazebo to protect the food being served at the event from sunlight, rain, and/or insects. Also, dining tables may be arranged underneath the portable gazebo so that attendees at the party may remain cooler by being shaded from direct sunlight. Because portable gazebos are typically only used for a certain duration of time (e.g., during a tailgate party or backyard party) and/or are often set up in a remote, temporary location (e.g., in the parking lot of a stadium), it is often necessary to assemble and disassemble the portable structure each time that it is utilized. In addition, even if the portable shelter is used in the backyard of the owner thereof, it still is often desirable to assemble and disassemble the portable structure each time that it is utilized in order to protect it from damage due to the elements of the outdoor environment (e.g., wind, rain, snow, etc.). As such, it is highly preferable that such portable shelters can be quickly and easily assembled and disassembled so that the users thereof are not spending an inordinate amount of time setting up for their events.

Although, conventional portable shelters often require a great deal of time to assemble and disassemble because they include a large collection of constituent components that must be fastened together using a plurality of different tools. Not only is the assembly of these conventional portable shelters time consuming, but it is also inconvenient, the users of such shelters are required to carry around a variety of different tools each time they want to assemble their portable shelter in a remote location. Also, if they accidently forget to bring one of the tools that is necessary to assemble the portable shelter, they may be precluded from assembling the shelter at all.

Therefore, what is needed is a portable shelter framing system that can be quickly and easily assembled and disassembled each time that it is used. Also, a portable shelter framing system is needed that is capable of being assembled and disassembled without the use of any tools. In addition, a portable shelter framing system is needed that is capable of being disassembled into a plurality of compact components that do not occupy a large amount of space when the portable shelter is transported and stored.

BRIEF SUMMARY OF EMBODIMENTS OF THE INVENTION

Accordingly, the present invention is directed to a portable shelter framing system that substantially obviates one or more problems resulting from the limitations and deficiencies of the related art.

In accordance with one or more embodiments of the present invention, there is provided a portable shelter framing system, which includes: a plurality of vertical support members; a plurality of crossbeam members, each of the crossbeam members configured to be connected between a pair of the plurality of vertical support members without the use of tools; and a plurality of roof frame members, each of the roof frame members configured to be coupled to one of the plurality of vertical support members or one of the plurality of crossbeam members without the use of tools.

In a further embodiment of the present invention, each of the plurality of vertical support members is in the form of a corner post member or a folding corner frame member.

In yet a further embodiment, each of the plurality of crossbeam members is configured to be folded approximately in half.

In still a further embodiment, each of the plurality of crossbeam members has opposed first and second end portions; each of the plurality of vertical support members has a pair of channel members oriented generally perpendicular to one another, and each of the pair of channel members is configured to receive a respective first or second end portion of one of the plurality of crossbeam members.

In yet a further embodiment, each of the plurality of crossbeam members further includes a first aperture provided in the first end portion and a second aperture provided in the second end portion; each of the pair of channel members on each the vertical support member further includes an aperture that is configured to substantially align with one of the first and second apertures on a respective crossbeam member when the crossbeam member and the vertical support member are engaged with one another; and each of the first and second end portions of each crossbeam member is configured to be secured to one of the pair of channel members on the vertical support member by means of a respective fastener passing through a respective one of the first and second apertures of the crossbeam member and a respective aperture of the channel member.

In still a further embodiment, each of the plurality of crossbeam members has opposed first and second end portions with one or more hook members; each of the plurality of vertical support members has outer side edges with one or more respective slots disposed therein; and each of the one or more hook members is configured to engage with a respective one of the one or more slots in one of the outer side edges of the vertical support member.

In yet a further embodiment, the portable shelter framing system further comprises a plurality of connecting members, each of the connecting members being configured to couple a respective one of the roof frame members to a respective one of the plurality of vertical support members or to a respective one of the plurality of crossbeam members without the use of tools.

In still a further embodiment, each of the plurality of connecting members includes a body portion having an aperture disposed therethrough and a shaft portion connected to the body portion, the aperture of the body portion configured to receive one of the plurality of roof frame members therein, and the shaft portion configured to be inserted into a receiving aperture in one of the plurality of vertical support members or one of the plurality of crossbeam members.

In yet a further embodiment, the shaft portion of each of the plurality of connecting members includes a circumferential groove, each of the plurality of connecting members configured to be securely coupled to one of the plurality of vertical support members or to one of the plurality of crossbeam members by means of a tool-less fastener engaging the circumferential groove of the shaft portion.

In still a further embodiment, each of the plurality of vertical support members is in the form of a folding corner frame member; and wherein the portable shelter framing system further comprises a plurality of corner insert members, each of the plurality of corner insert members configured to couple a respective one of the plurality of connecting members to a respective one of the plurality of folding corner frame members without the use of tools.

In yet a further embodiment, the portable shelter framing system further comprises a central connecting member having a plurality of outwardly extending tubular members, each of the plurality of roof frame members configured to engage with a respective one of the plurality of outwardly extending tubular members of the central connecting member.

In still a further embodiment, the plurality of roof frame members includes one or more corner roof frame members comprising a pair of generally parallel, spaced apart tubular members, the pair of tubular members being connected to one another by one or more intersecting tubular members that are disposed generally perpendicular thereto.

In yet a further embodiment, the portable shelter framing system further comprises one or more roof frame connecting members having branched tubular portions, at least some of the plurality of roof frame members configured to engage with a respective one of the branched tubular portions of the one or more roof frame connecting members.

In still a further embodiment, each of the plurality of vertical support members is in the form of a folding corner frame member; and wherein some of the plurality of roof frame members have downturned end portions that are configured to be received within respective apertures in the folding corner frame members.

In yet a further embodiment, each of the plurality of crossbeam members includes a diagonally extending tubular connecting member, each of the diagonally extending tubular connecting members configured to engage a respective one of the plurality of roof frame members.

In accordance with one or more other embodiments of the present invention, there is provided a portable shelter framing system, which includes: a plurality of vertical support members; a plurality of crossbeam members, each of the crossbeam members configured to be connected between a pair of the plurality of vertical support members without the use of tools; a plurality of roof frame members, each of the roof frame members configured to be circumferentially spaced apart from one another so as to form a supporting structure for a roof material; and a plurality of connecting members, each of the connecting members configured to couple a respective one of the plurality of roof frame members to a respective one of the plurality of vertical support members or to a respective one of the plurality of crossbeam members without the use of tools.

In a further embodiment of the present invention, each of the plurality of connecting members includes a body portion having an aperture disposed therethrough and a shaft portion connected to the body portion, the aperture of the body portion configured to receive one of the plurality of roof frame members therein, and the shaft portion configured to be inserted into a receiving aperture in one of the plurality of vertical support members or one of the plurality of crossbeam members.

In yet a further embodiment, each of the plurality of vertical support members is provided with a tubular sleeve disposed therein that forms the receiving aperture for the shaft portion of the connecting member.

In still a further embodiment, at least some of the plurality of roof frame members are provided with a collar portion for preventing an axial movement of the roof frame member when the roof frame member is engaged with the aperture in the body portion of a respective connecting member.

In accordance with yet one or more other embodiments of the present invention, there is provided a portable shelter framing system, which includes: a plurality of vertical support members; a plurality of folding crossbeam members, each of the plurality of folding crossbeam members configured to be folded approximately in half, and each of the folding crossbeam members configured to be connected between a pair of the plurality of vertical support members without the use of tools; and a plurality of roof frame members, each of the roof frame members configured to be coupled to one of the plurality of vertical support members or one of the plurality of folding crossbeam members without the use of tools.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
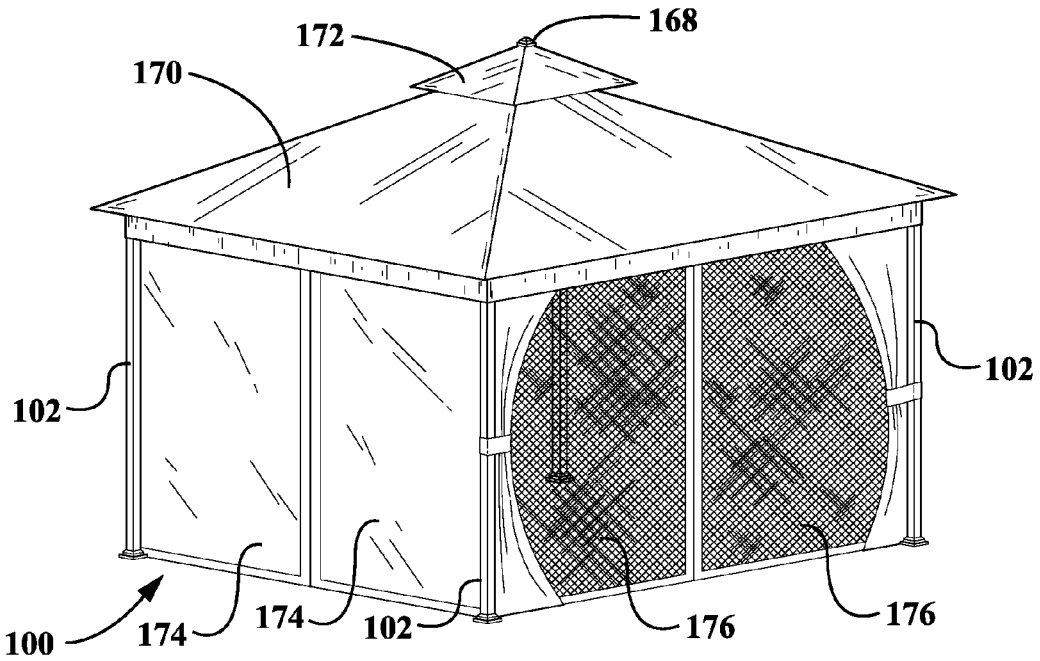
FIG. 1 is a perspective view of a portable shelter, according to a first embodiment of the invention, wherein the side panels and the roof canopy are shown disposed on the portable shelter.

A first exemplary embodiment of the portable shelter or gazebo is seen generally at 100 in FIGS. 1-18. Initially, referring primarily to the assembled perspective view of FIG. 4 and the exploded perspective view of FIG. 18, it can be seen that the portable shelter framing system of the portable shelter 100 generally comprises a plurality of vertical support members (e.g., corner support posts 102); a plurality of crossbeam members 112, 126, each of the crossbeam members 112, 126 configured to be connected between a pair of the plurality of vertical support members 102 without the use of tools; and a plurality of roof frame members 148, 150, 152, 160, each of the roof frame members 148, 150, 152, 160 configured to be coupled to one of the plurality of vertical support members 102 or one of the plurality of crossbeam members 112, 126 without the use of tools. Advantageously, the portable shelter or gazebo 100 is designed to be assembled without the use of any tools, such as screwdrivers, wrenches, etc. Not only does this substantially reduce the time which is required to assemble the portable shelter or gazebo 100, but it also permits the portable shelter or gazebo 100 to be installed by a user who does not have access to any tools.

Figure 8:
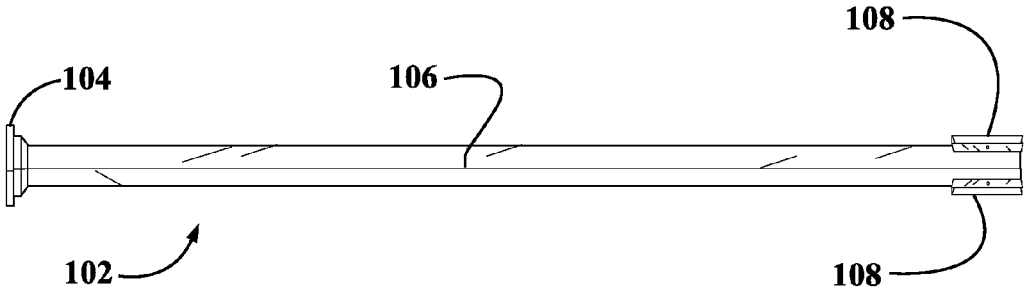
FIG. 8 is a side perspective view of one of the vertical support members of the portable shelter, according to the first embodiment of the invention, wherein the vertical support member is in the form of a corner post member.
Figure 17:
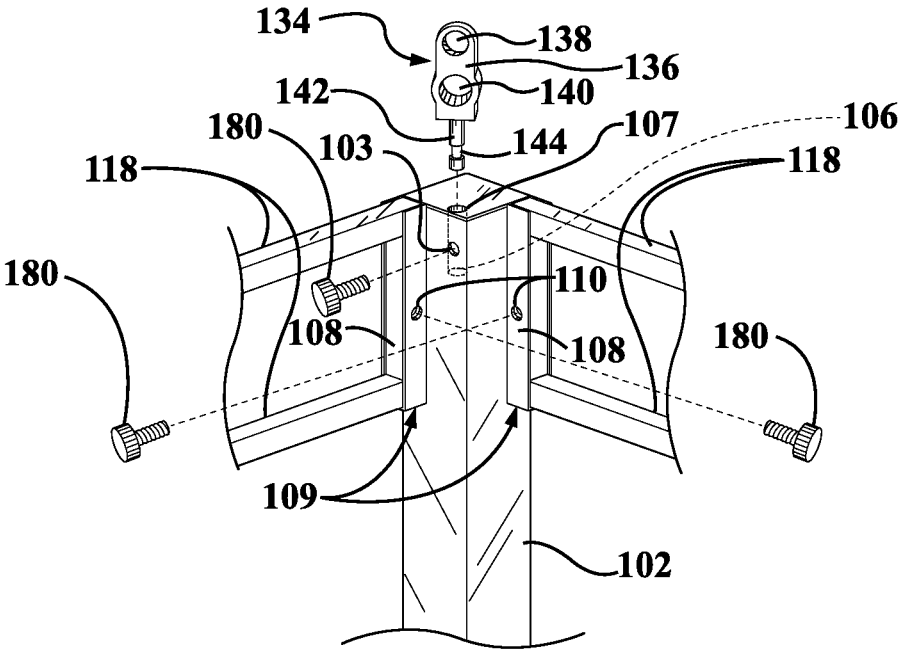
FIG. 17 is an enlarged perspective view of crossbeam members attached to one of the vertical support members of the portable shelter, according to the first embodiment of the invention, wherein one of the connecting members also is illustrated exploded therefrom.

As shown in FIGS. 1-4 and 18, the vertical support members of the portable shelter framing system of the first illustrated embodiment are in the form of corner post members 102. With reference to FIG. 8, it can be seen that each corner post member 102 includes a base portion 104, a tubular body portion 106, and a pair of C-shaped channel members 108 that are disposed proximate to the end of the tubular body portion 106 (e.g., the top end), which is opposite to the end having the base portion 104 (e.g., the bottom end). The pair of channel members 108 are oriented generally perpendicular to one another (i.e., on adjacent sides of the tubular body portion 106 of the corner post member 102). Each of the pair of channel members 108 is configured to receive an end portion 112*a*, 112*b*, 126*a*, 126*b* of one of the plurality of crossbeam members 112, 126 (see FIG. 18). As best shown in the connection detail of FIG. 17, each of the channel members 108 comprises a bottom base plate 109 that is secured to a side of the tubular body portion 106 of the corner post member 102 and two spaced-apart side plates that are attached to opposed sides of the bottom base plate 109. In FIG. 17, it can be seen that one of the side plates is provided with an aperture 110 disposed therethrough for receiving a fastener member 180.

Figure 10:
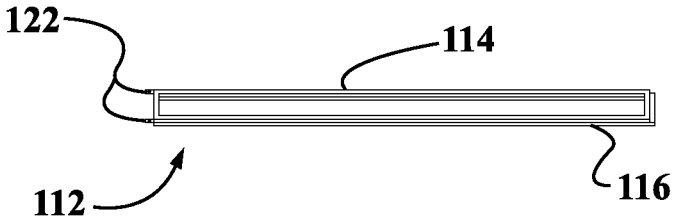
FIG. 10 is a side perspective view of one of the folding crossbeam members of the portable shelter, according to the first embodiment of the invention, wherein the folding crossbeam member is shown in a folded state.
Figure 16:
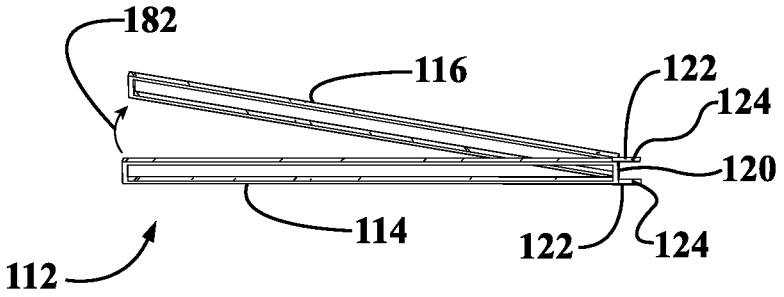
FIG. 16 is a side perspective view of one of the folding crossbeam members of the portable shelter, according to the first embodiment of the invention, wherein the folding crossbeam member is shown in a partially unfolded state.

Now, with reference to FIGS. 4, 10, 16, and 18, the crossbeam members 112, 126 will be described in detail. As best shown in the perspective view of FIG. 4, the portable shelter framing system of the portable shelter 100 includes a pair of first crossbeam members 112 with first and second sections 114, 116 and a pair of second crossbeam members 126 with first and second sections 128, 130. The first crossbeam members 112 are essentially the same as the second crossbeam members 126, except that the first crossbeam members 112 have a longer length than the second crossbeam members 126 (the portable shelter 100 has a generally rectangular shape with two longer sides and two shorter sides). Advantageously, in the illustrative embodiment, each of the crossbeam members 112, 126 is capable of being folded approximately in half so as to reduce the amount of space that each crossbeam member 112, 126 occupies when the portable shelter 100 is being stored and transported (in its disassembled state). The foldable nature of the crossbeam members 112, 126 is shown in FIGS. 10 and 16. With particular reference to FIG. 16, it can be seen that the second section 116 of the crossbeam member 112 can be rotated in a clockwise direction 182 relative to the first section 114 of the crossbeam member 112 until the crossbeam member 112 is unfolded, wherein the first and second sections 114, 116 are disposed in a generally linear arrangement. During the unfolding of the crossbeam member 112, the second section 116 rotates about a pivotal axis disposed through the hinge member 120 (see detailed view of FIG. 25). Once the second section 116 has been rotated approximately 180 degrees relative to the first section 114, and the crossbeam member 112 is completely unfolded, the second section 116 is locked in place relative to the first section 114 by the engagement of the opposed pins 125 on the second section 116 with the corresponding apertures 124 in the projecting members 122 of the first section 114. As shown in FIG. 16, the projecting members 122 extend from the end of the first section 114. Each of the first and second sections 114, 116 of the crossbeam members 112 is in the form of a rectangular-shaped tubular frame 118.

Figure 15:
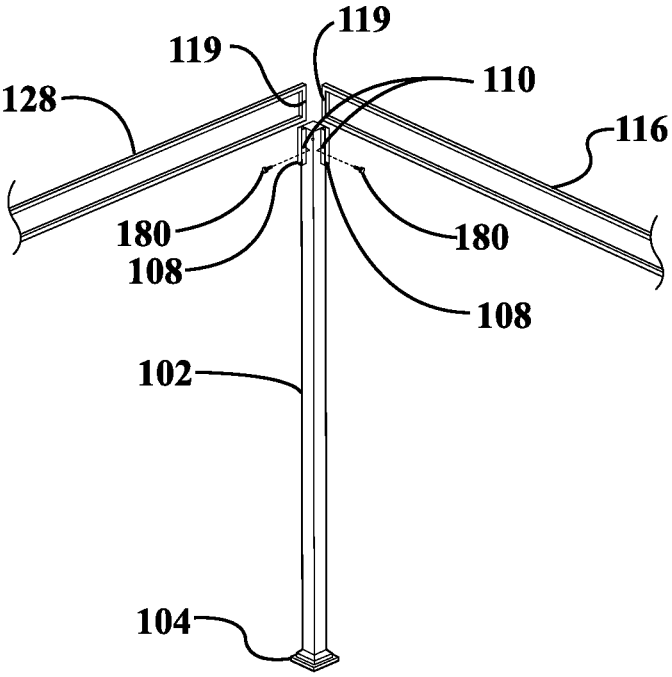
FIG. 15 is an exploded perspective view illustrating two partial crossbeam members exploded from a vertical support member of the portable shelter, according to the first embodiment of the invention.
Figure 18:
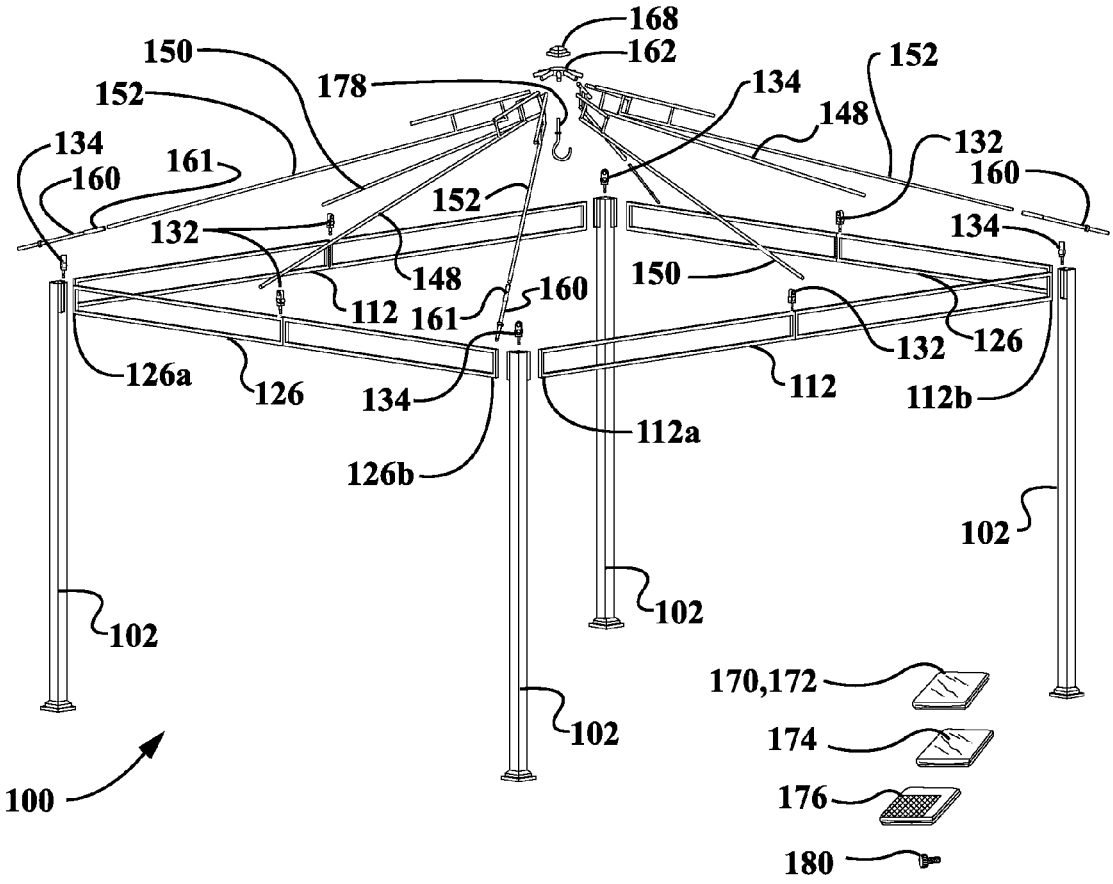
FIG. 18 is an overall exploded perspective view of the portable shelter framing system, according to the first embodiment of the invention, wherein the four post-type portable shelter is provided with framing for a roof vent.

Referring particularly to FIG. 18, it can be seen that each of the crossbeam members 112, 126 has opposed first and second end portions 112*a*, 112*b* and 126*a*, 126*b*. As best illustrated in FIG. 15, each of the crossbeam members 112, 126 further includes a first aperture 119 provided in a first end portion 112*a* or 126*a* and a second aperture 119 provided in a second end portion 112*b* or 126*b*. The apertures 110 in the sides of the channel members 108 are configured to substantially align with one of the first and second apertures 119 on a respective crossbeam member 112, 126 when the crossbeam member 112, 126 and the vertical support member 102 are engaged with one another (as shown in the detail of FIG. 17). Each of the first and second end portions 112*a*, 112*b*, 126*a*, 126*b* of each crossbeam member 112, 126 is secured to a respective C-shaped channel member 108 on the vertical support member 102 by means of a respective fastener 180 passing through a respective one of the first and second apertures 119 of the crossbeam member 112, 126 and a respective aperture 110 of the channel member 108.

Figure 4:
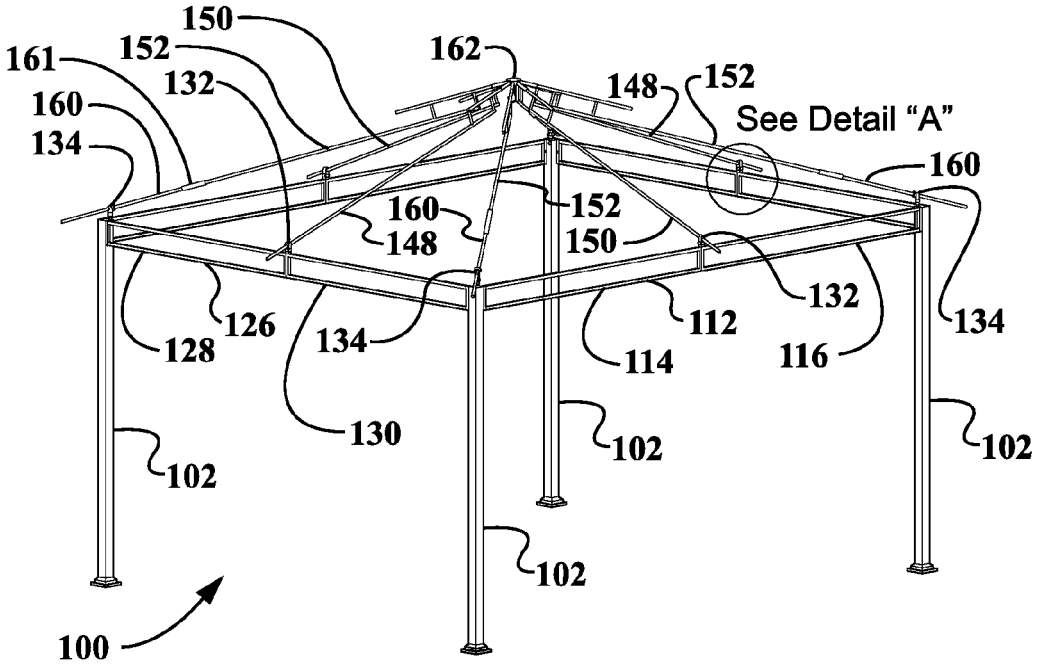
FIG. 4 is still another perspective view of the portable shelter, according to the first embodiment of the invention, wherein the side panels, the peripheral roof canopy portion, and the central roof canopy portion have all been removed from the portable shelter to better illustrate the framing system thereof.
Figure 5:
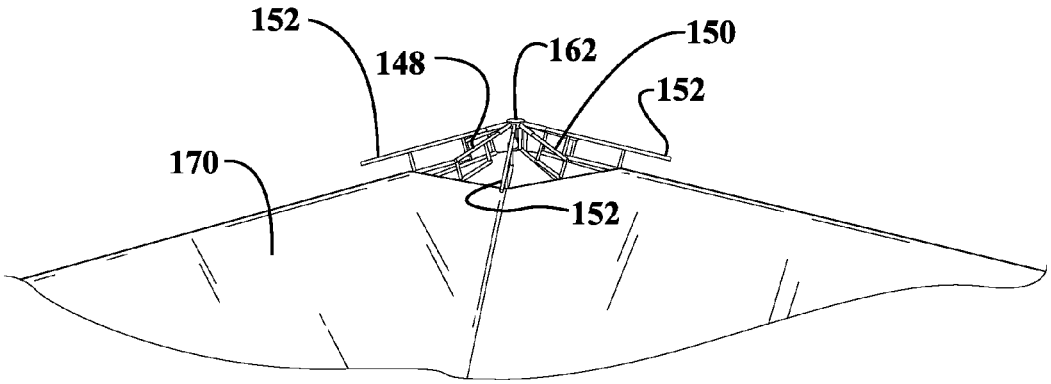
FIG. 5 is a partial perspective view of the central roof portion of the portable shelter, according to the first embodiment of the invention, wherein the central roof canopy portion has been removed to better illustrate the roof framing members.
Figure 11:
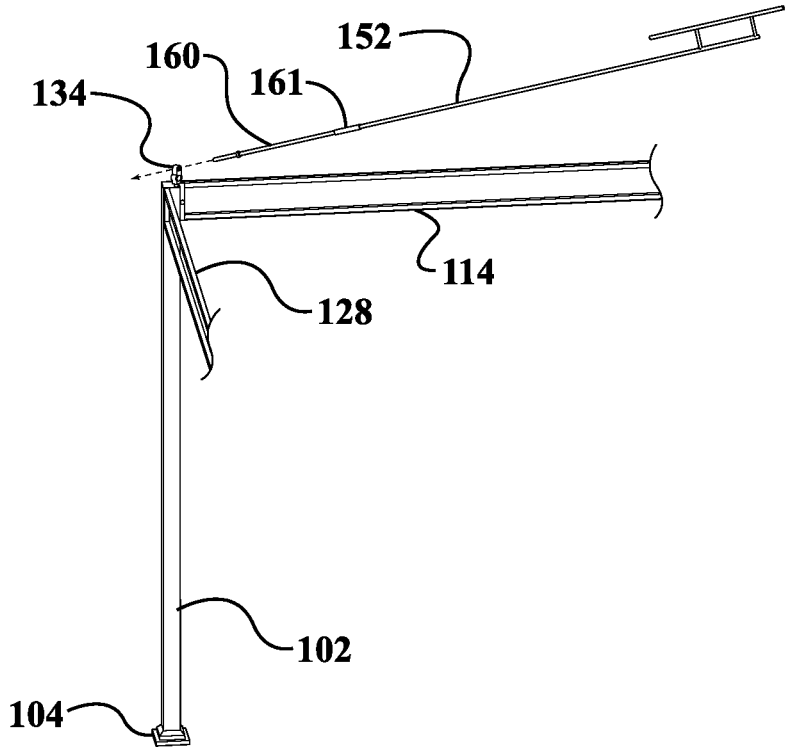
FIG. 11 is a perspective view of partial crossbeam members attached to one of the vertical support members of the portable shelter, according to the first embodiment of the invention, wherein one of the corner roof frame members also is illustrated exploded therefrom.
Figure 12:
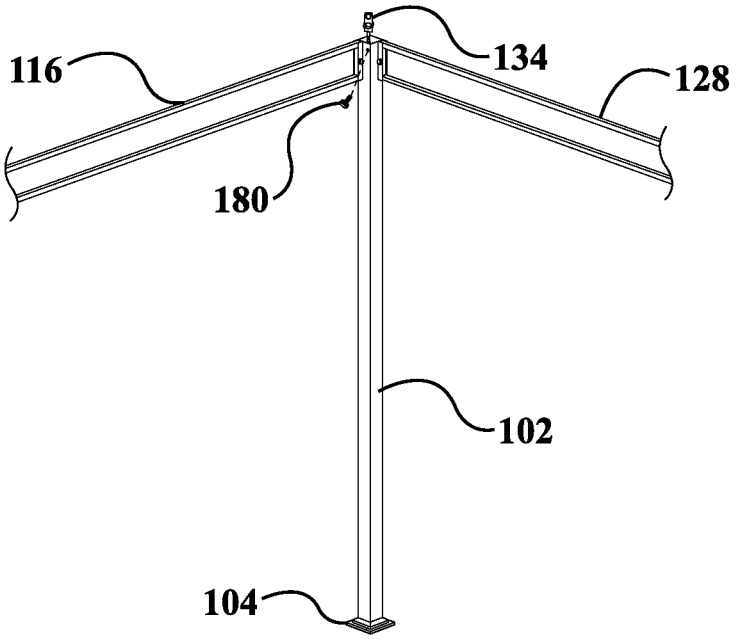
FIG. 12 is a perspective view of partial crossbeam members attached to one of the vertical support members of the portable shelter, according to the first embodiment of the invention, wherein one of the connecting members also is illustrated exploded therefrom.
Figure 13:
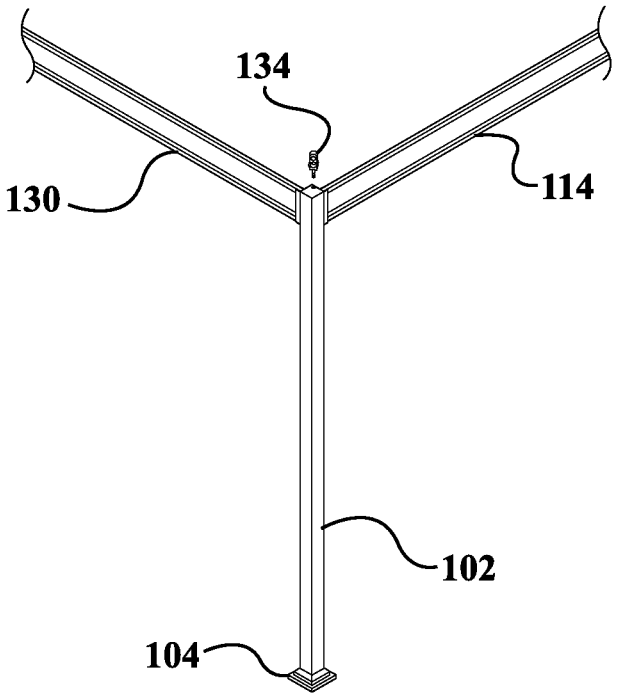
FIG. 13 is another perspective view of partial crossbeam members attached to one of the vertical support members of the portable shelter, according to the first embodiment of the invention, wherein one of the connecting members also is illustrated exploded therefrom.
Figure 14:
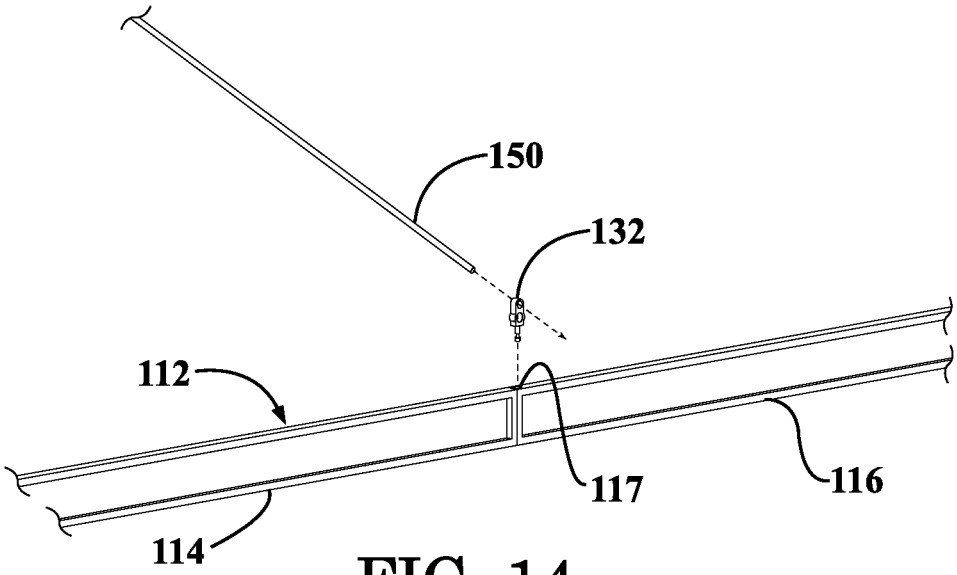
FIG. 14 is a perspective view of a partial unfolded crossbeam member illustrated with one of the connecting members of the portable shelter, according to the first embodiment of the invention, wherein one of the middle roof frame members also is illustrated exploded therefrom.
Figure 25:
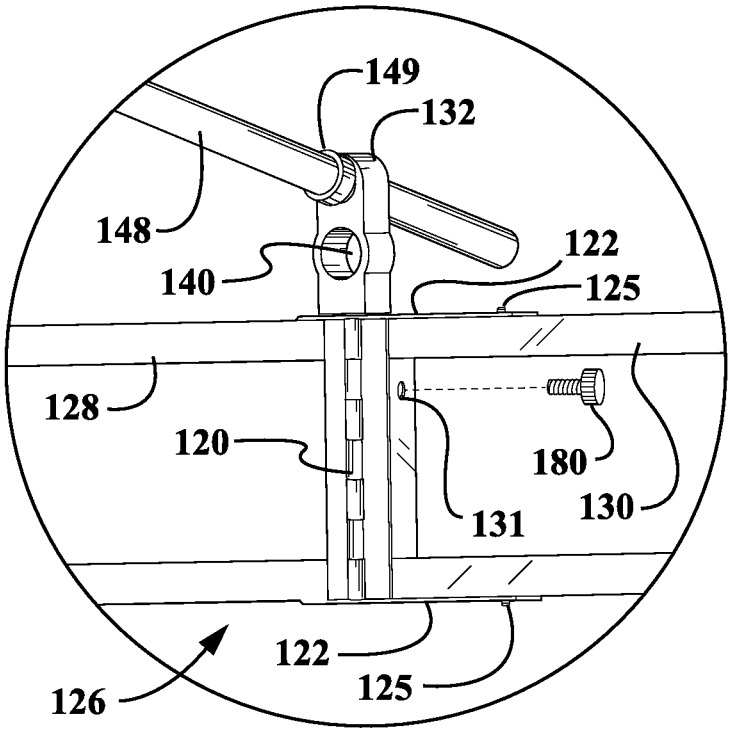
FIG. 25 is an enlarged, partial perspective view of the connection between one of the middle roof frame members and one of the crossbeam members in FIG. 4 (Detail "A"), according to the first and second embodiments of the invention.

Next, with reference to FIGS. 4, 17, and 18, the connecting members 132, 134 of the portable shelter framing system will be explained in detail. As shown in FIGS. 4 and 18, the connecting members 132 couple a respective one of the middle roof frame members 148, 150 to a respective one of the crossbeam members 126, 112 without the use of tools. Similarly, the connecting members 134 couple a respective one of the corner roof frame members 160 to a respective one of the vertical support members 102 without the use of tools. As best illustrated in the detailed view of FIG. 17, each connecting member 132, 134 includes a body portion 136 and a shaft portion 142 connected to the body portion 136. The body portion 136 of each connecting member 132, 134 has upper and lower apertures 138, 140 disposed therethrough. As shown in FIGS. 4, 14, and 25, the upper aperture 138 of the body portion 136 of each connecting member 132 receives a respective middle roof frame member 148, 150 therein. Similarly, as illustrated in FIGS. 4 and 11, the upper aperture 138 of the body portion 136 of each connecting member 134 receives a respective corner roof frame member 160 therein. Then, turning to FIG. 14, it can be seen that the shaft portion 142 of each connecting member 132 is designed to be inserted into a receiving aperture 117 in the top surface of a respective crossbeam member 112 (or the crossbeam member 126). In FIG. 17, it can be seen that the shaft portion 142 of each connecting member 134 is designed to be inserted into a receiving aperture 107 in the top surface of a respective vertical support member 102. In the illustrated embodiment, each vertical support member 102 is provided with a tubular sleeve 106 disposed therein that forms the receiving aperture 107 for the shaft portion 142 of each connecting member 134.

As shown in FIG. 17, the shaft portion 142 of each connecting member 134 (and each connecting member 132) is provided with a circumferential groove 144 disposed therein. Each of the connecting members 134 is securely coupled a respective one of the vertical support members 102 by means of the tool-less fastener 180 engaging the circumferential groove 144 of the shaft portion 142. That is, a user inserts the fastener 180 into the aperture 103 in the side of the vertical support member 102, and then, by using the knurled cap of the fastener 180, the user tightens the fastener 180 in the aperture 103 until the distal end portion (opposite the cap) of the fastener 180 engages the circumferential groove 144 in the shaft portion 142 of the connecting member 134. The engagement between the distal end portion of the fastener 180 and the circumferential groove 144 prevents the axial movement of the connecting member 134 relative to the vertical support member 102, thereby securing the connecting member 134 in place. Similarly, referring to FIG. 25, each of the connecting members 132 is securely coupled to a respective one of the crossbeam members 126 (or to one of the crossbeam members 112) by means of the fastener 180 engaging the circumferential groove 144 of the shaft portion 142. In particular, a user inserts the fastener 180 into the aperture 131 in the side of the tubular frame of folding crossbeam member 126, and then, by grasping the knurled cap of the fastener 180 with his or her fingers, the user tightens the fastener 180 in the aperture 131 until the distal end portion (opposite the cap) of the fastener 180 engages the circumferential groove 144 in the shaft portion 142 of the connecting member 132. Similar to that described above for the engagement between the connecting member 134 and the vertical support member 102, the engagement between the distal end portion of the fastener 180 and the circumferential groove 144 prevents the axial movement of the connecting member 132 relative to the crossbeam member 126 (or the crossbeam member 112), thereby securing the connecting member 132 in place.

Now, with initial reference to FIGS. 4 and 18, the roof frame members of the portable shelter framing system of the first illustrative embodiment will be described. In general, it can be seen that the roof frame members 148, 150, 152 are circumferentially spaced apart from one another so as to form a supporting structure for a roof material, such as a canvas covering material. An upper end of each the roof frame members 148, 150, 152 is designed to be inserted into a respective outwardly extending tubular member 166 of a central connecting member 162 (see FIGS. 6 and 7). The central connecting member 162 has a central body portion 164 with a plurality of peripheral tubular members 166 extending outwardly therefrom. As such, the central connecting member 162 generally resembles an octopus, wherein the central body portion 164 forms the body of the octopus and the peripheral tubular members 166 form the legs of the octopus. As shown in the assembled perspective view of FIG. 4, each of the roof frame members 148, 150, 152 engages with a respective one of the peripheral tubular members 166 of the central connecting member 162 so that a generally rigid roof structure is formed thereby.

Figure 6:
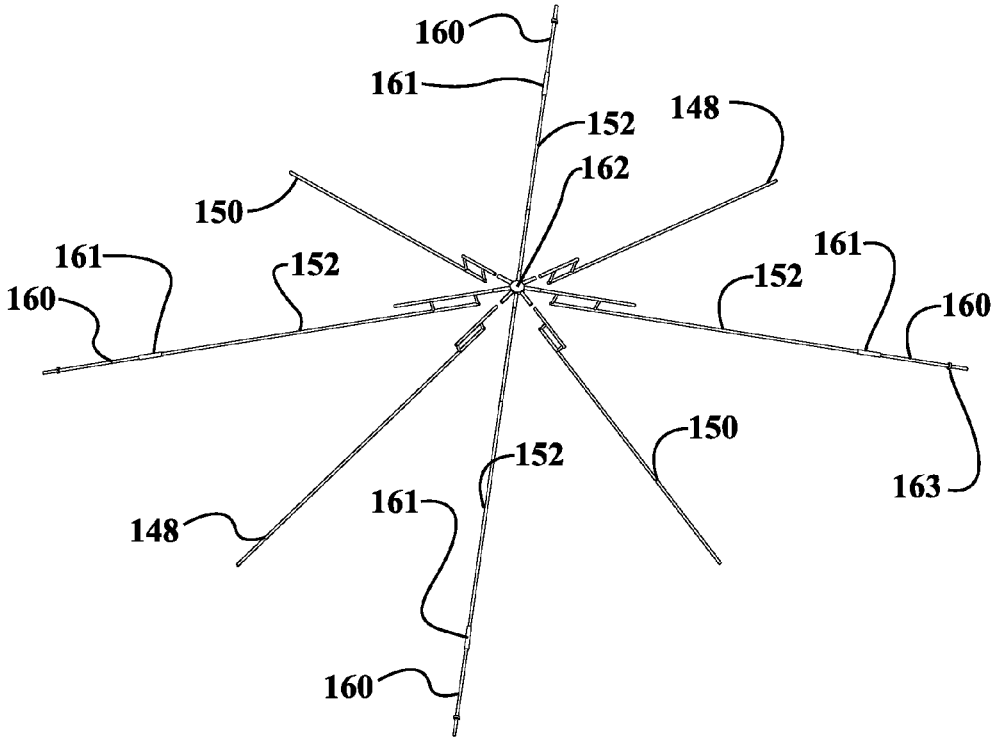
FIG. 6 is a partially exploded perspective view of the roof frame assembly of the portable shelter, according to the first embodiment of the invention.
Figure 7:
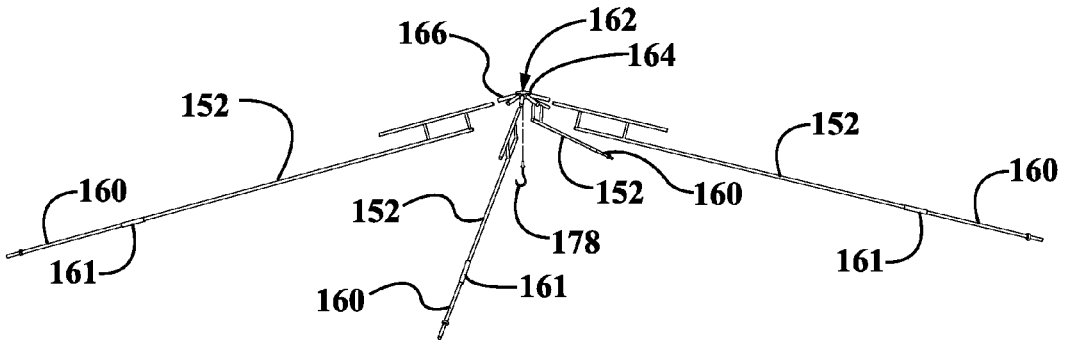
FIG. 7 is a partially exploded perspective view of the corner roof frame members and the central connecting member of the portable shelter, according to the first embodiment of the invention.

In the illustrated embodiment, the roof framing members include two (2) middle roof frame members 148 having a first length, two (2) middle roof frame members 150 having a second length, four (4) corner roof frame members 152, and four (4) corner roof frame extension members 160. As shown in FIG. 18, the first length of the middle roof frame members 148 is greater than the second length of the middle roof frame members 150. As best shown in FIGS. 6, 7, and 18, the corner roof frame extension members 160 are provided with belled end portions 161 so that they are capable of receiving a lower end portion of a respective corner roof frame member 152. That is, the corner roof frame extension members 160 attach to the ends of the corner roof frame members 152, thereby extending their overall length. Also, referring again to FIGS. 6, 7, and 18, it can be seen that each of the roof frame extension members 160 is provided with a collar portion 163 for preventing an axial movement of the roof frame extension member 160 when the roof frame extension member 160 is engaged with the aperture 138 in the body portion 136 of a respective connecting member 132, 134 (also refer to FIG. 25 for a detailed view of a collar portion 149 on a middle roof frame member 148). That is, the collar portion 149 can also be provided on each middle roof frame member 148, 150 to prevent the middle roof frame members 148, 150 from sliding downwardly in the aperture 138.

Figure 9:
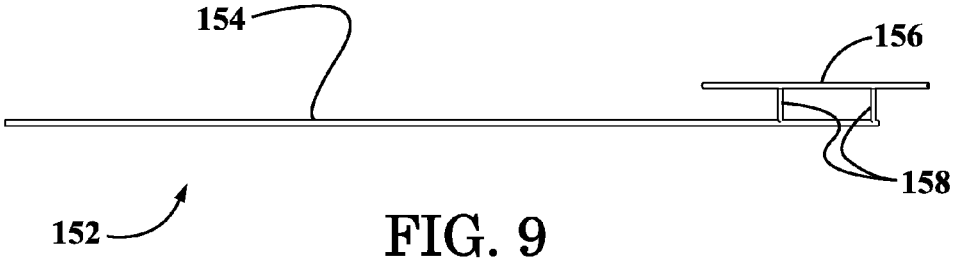
FIG. 9 is a side view of one of the corner roof frame members of the portable shelter, according to the first embodiment of the invention.

A detailed view of one of the corner roof frame members 152 is shown in FIG. 9. Referring to this figure, it can be seen that the corner roof frame member 152 includes a pair of generally parallel, spaced apart lower and upper tubular members 154, 156. The lower tubular member 152 is substantially longer than the upper tubular member 156, and it supports the primary roof of the portable shelter 100. The short upper tubular member 156 is used to support the roof vent cover in the roof of the portable shelter 100 (see FIGS. 3 and 4). The pair of tubular members 154, 156 are connected to one another by two spaced apart tubular members 158, which are each disposed generally perpendicular to each of the lower and upper tubular members 154, 156. The tubular members 158 form the gap that is required for the roof vent in the portable shelter 100.

Figure 2:
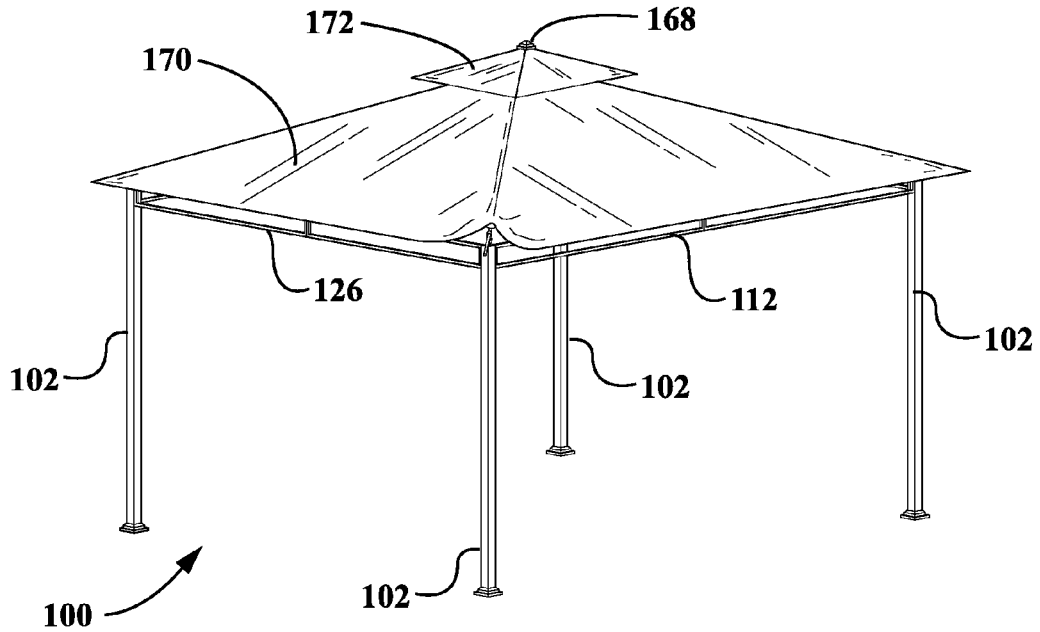
FIG. 2 is another perspective view of the portable shelter, according to the first embodiment of the invention, wherein the side panels have been removed from the portable shelter.
Figure 3:
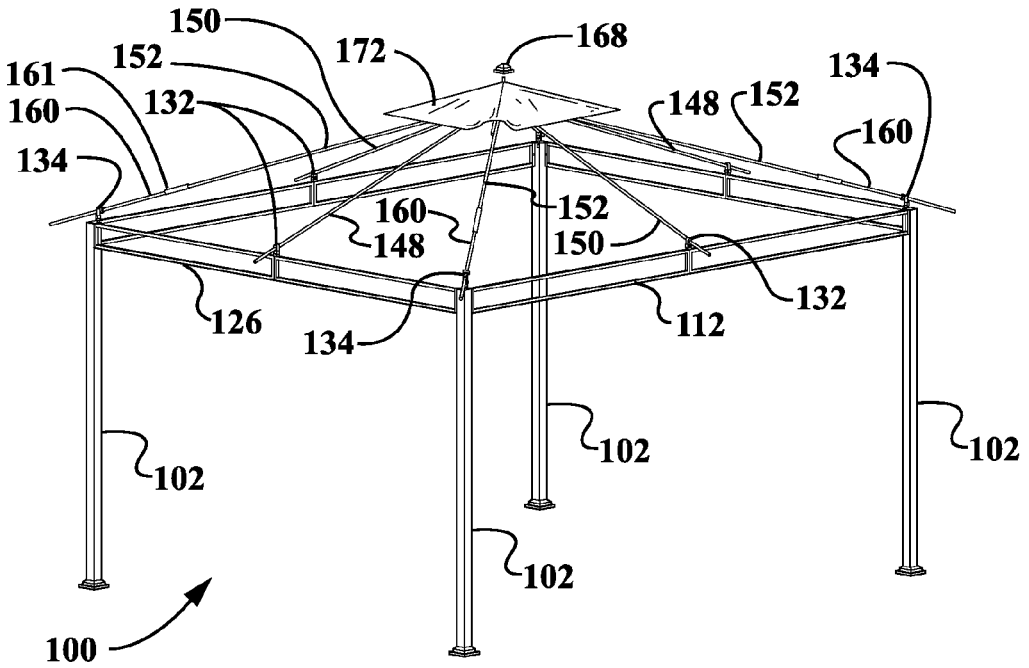
FIG. 3 is yet another perspective view of the portable shelter, according to the first embodiment of the invention, wherein both the side panels and the peripheral roof canopy portion have been removed from the portable shelter to better illustrate the framing system thereof.

Turning to FIGS. 1-3 and 18, the exterior coverings and other features of the portable shelter 100 will now be described. As best shown in FIGS. 1 and 2, a peripheral roof canopy portion 170 covers a majority of the roof framing system, while a central roof canopy portion 172 is disposed over the upper tubular members 156 of the corner roof frame members 152 that form the roof vent of the portable shelter 100. Together the peripheral roof canopy portion 170 and the central roof canopy portion 172 form the roof of the portable shelter 100. In FIGS. 1-3, it can be seen that a finial member 168 is provided at the central peak of the central roof canopy portion 172 to hold the canopy portion 172 in place. For example, the finial member 168 may be attached to the central connecting member 162 by a suitable fastener. In FIGS. 7 and 18, it can be seen that the underside of the central connecting member 162 is provided with a hook member 178 attached thereto (e.g., the end portion of the hook member 178 may be provided with a plurality of external threads that matingly engage with a plurality of internal threads on the central connecting member 162). As an example, the hook member 178 may be used for holding a hanging plant or a light inside the portable shelter 100.

In FIG. 1, it can be seen that one or more sides of the portable shelter 100 are provided with substantially solid side curtain panels 174, while one or more other sides of the portable shelter 100 are provided with netted side curtain panels 176. The netted side curtain panels 176 are designed to permit airflow therethrough, yet keep insects from entering the interior of the portable shelter 100. As shown in FIG. 1, the side curtain panels 174, 176 are supported from the support post members 102 and the crossbeam members 112, 126 of the portable shelter 100 by fastening straps or other suitable fastening members.

In one or more embodiments, the constituent components of the portable shelter framing system (e.g., as illustrated in FIGS. 4 and 18) are formed from a suitable metallic material, such as steel, while the roof canopy portions 170, 172 and the side curtain panels 174, 176 are formed from a suitable fabric, such as a polyester fabric material. However, those of ordinary skill in the art will appreciate that other suitable materials can be used for the various components of the portable shelter 100 as well.

Figure 19:
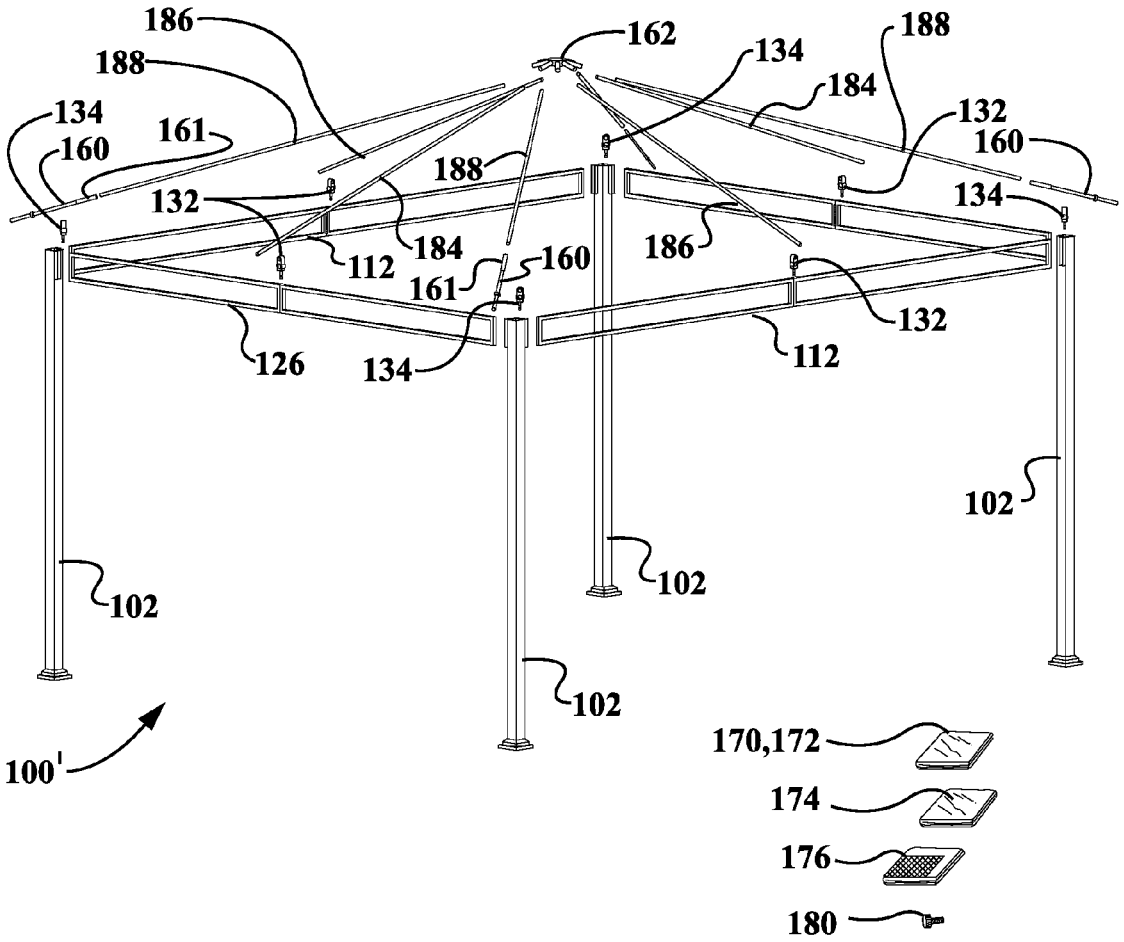
FIG. 19 is an overall exploded perspective view of a portable shelter framing system, according to a second embodiment of the invention, wherein the four post-type portable shelter is not provided with framing for a roof vent.

A second exemplary embodiment of the portable shelter or gazebo is seen generally at 100' in FIG. 19. Referring to this figure, it can be seen that, in many respects, the second exemplary embodiment is similar to that of the first embodiment. Moreover, many elements are common to both such embodiments. For the sake of brevity, the elements that the second embodiment of the portable shelter has in common with the first embodiment will not be discussed because these components have already been explained in detail above. Furthermore, in the interest of clarity, these elements are denoted using the same reference characters that were used in the first embodiment.

In the second exemplary embodiment, unlike the first exemplary embodiment, the roof of the portable shelter 100' is not provided with a roof vent. As such, the roof framing members of the portable shelter 100' are different from those described above for the first exemplary embodiment. In all other respects, portable shelter 100' is generally the same as the portable shelter 100.

The roof framing members of the portable shelter 100' will be described with reference to FIG. 19. In this figure, it can be seen that the portable shelter 100' has two (2) middle roof frame members 184 having a first length, two (2) middle roof frame members 186 having a second length, four (4) corner roof frame members 188, and four (4) corner roof frame extension members 160. As shown in FIG. 19, the first length of the middle roof frame members 184 is greater than the second length of the middle roof frame members 186. Unlike the roof frame members 148, 150, and 152 described above in conjunction with the first embodiment, the roof frame members 184, 186, and 188 do not contain the upper spaced-apart tubular members (e.g., members 156) that are used to create the roof vent gap in the portable shelter roof. Rather, as illustrated in FIG. 19, each of the roof frame members 184, 186, and 188 comprises a generally linear tubular member that is attached to the central connecting member 162.

Figure 20:
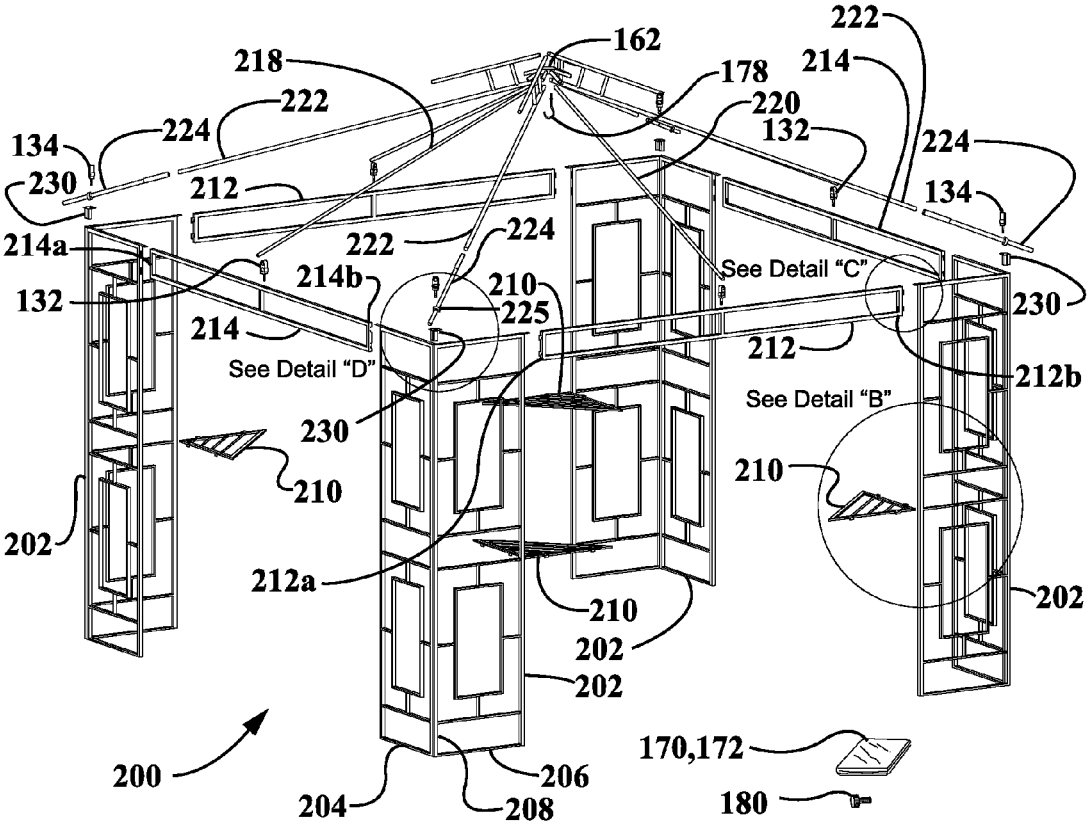
FIG. 20 is an overall exploded perspective view of a portable shelter framing system, according to a third embodiment of the invention, wherein a folding corner panel-type portable shelter is provided with framing for a roof vent.

A third exemplary embodiment of the portable shelter or gazebo is seen generally at 200 in FIG. 20, and details of the third embodiment are shown in FIGS. 26-29. Referring to these figures, it can be seen that, in some respects, the third exemplary embodiment is similar to that of the preceding two embodiments. Moreover, some elements are common to all of the embodiments. For the sake of brevity, the elements that the third embodiment of the portable shelter has in common with the first and second embodiments will not be discussed because these components have already been explained in detail above. Furthermore, in the interest of clarity, these elements are denoted using the same reference characters that were used in the first two embodiments.

In the third exemplary embodiment, unlike the first and second embodiments, the vertical support members are in the form of folding corner frame members 202, rather than corner post members 102. Also, in the third embodiment, the crossbeam members 212, 214 utilize different connection means for attaching to the vertical support members 202, as compared to that which was described above for the first embodiment. In addition, unlike the crossbeam members 112, 126 of the first and second embodiments, the crossbeam members 212, 214 do not fold approximately in half. Rather, the crossbeam members 212, 214 are generally in the form of non-folding, generally linear beams. In the third embodiment, the connecting members 134 are also attached to the vertical support members 202 in a different manner than that which was explained above for the first and second embodiments. Finally, the structures of the roof frame members 218-226 differ from those described in conjunction with the preceding two embodiments.

Figure 28A:
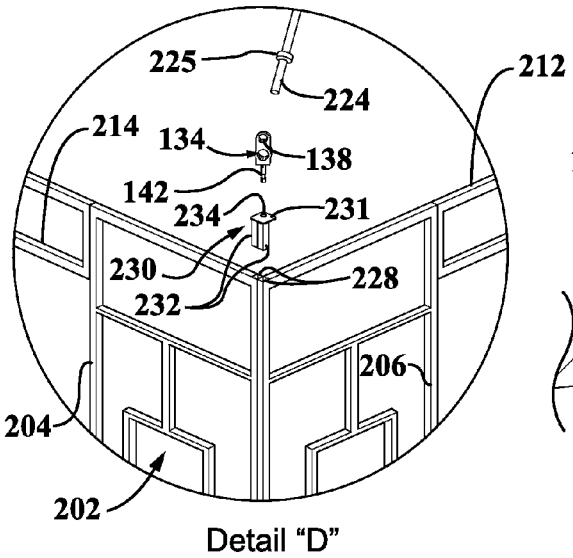
FIG. 28A is an enlarged, partial perspective view of the connection between one of the corner tubular roof frame members and one of the folding corner frame members in FIG. 20 (Detail "D"), according to the third and fourth embodiments of the invention.
Figure 28B:
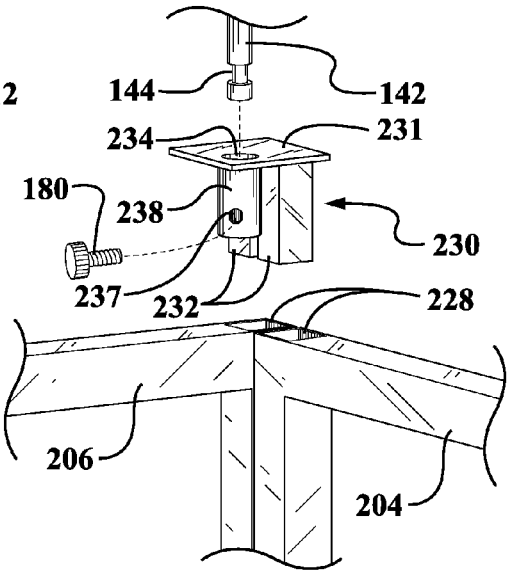
FIG. 28B is an enlarged, partial perspective view of the connection between one of the connecting members, one of the corner insert members, and one of the folding corner frame members in FIGS. 20 and 21, according to the third and fourth embodiments of the invention.
Figure 29:
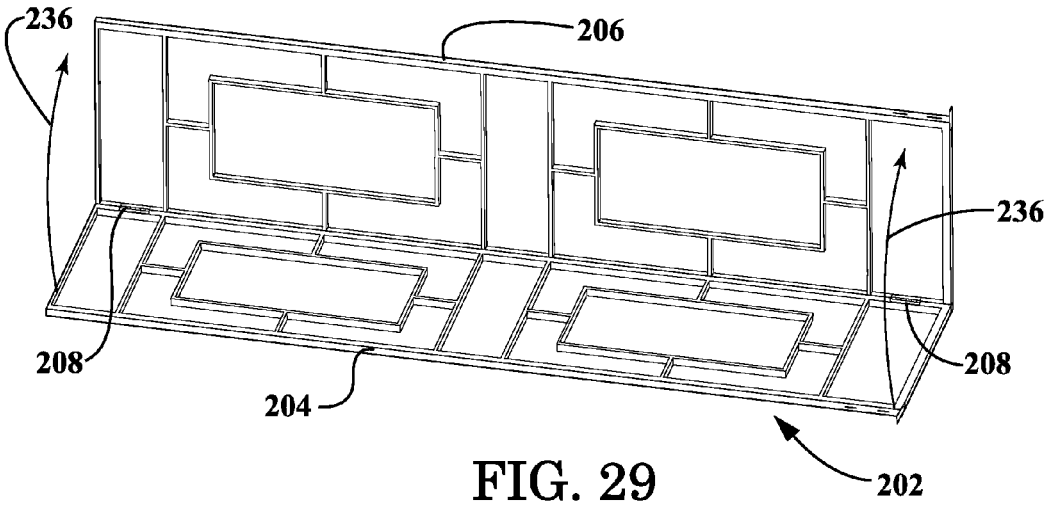
FIG. 29 is a side perspective view of one of the folding corner frame members of the portable shelter in FIGS. 20 and 21, according to the third and fourth embodiments of the invention, wherein the folding corner frame member is shown in an unfolded state.

Turning to FIGS. 20 and 29, it can be seen that the vertical support members of the portable shelter framing system of the third illustrated embodiment are in the form of folding corner frame members 202 (or folding corner panel members 202). With reference to these two figures, it can be seen that each folding corner frame member 202 includes a first panel section 204, a second panel section 206 pivotally coupled to the first panel section 204, and a plurality of hinge members 208 pivotally coupling the second panel section 206 to the first panel section 204. In FIG. 29, it can be seen that the second section 206 of the folding corner frame member 202 can be rotated in a clockwise direction 236 relative to the first section 204 of the folding corner frame member 202 until corner frame member 202 is completely unfolded, wherein the second section 206 is disposed generally perpendicular to the first section 204. During the unfolding of the corner frame member 202, the second section 206 rotates about a pivotal axis disposed through the hinge members 208 until the second section 206 has been rotated approximately 90 degrees relative to the first section 204, and the corner frame member 202 is completely unfolded. After the corner frame member 202 has been unfolded, the second section 206 can be locked in place relative to the first section 204 by inserting the corner insert member 230 into the insert apertures 228 of the corner frame member 202 (see FIGS. 28A and 28B).

Figure 26:
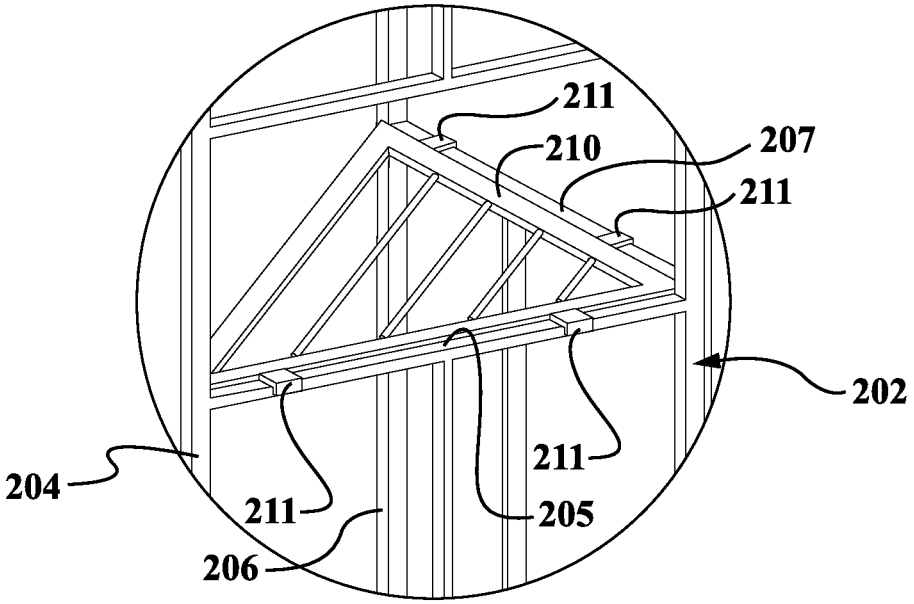
FIG. 26 is an enlarged, partial perspective view of the connection between one of the side panel shelf members and one of the folding corner frame members in FIG. 20 (Detail "B"), according to the third and fourth embodiments of the invention.

As shown in FIGS. 20 and 26, each of the corner frame members 202 is designed to accommodate a triangular-shaped shelf member 210. In the typical connection detail of FIG. 26, it can be seen that each of the shelf members 210 is provided with a plurality L-shaped prongs 211 (e.g., two prongs on each of two adjacent sides) for coupling the shelf member 210 to its respective corner frame member 202. Specifically, as shown in FIG. 26, the first pair of L-shaped prongs 211 is designed to engage with the transverse bar 205 of the first section 204 of the corner frame member 202, while the second pair of L-shaped prongs 211 is designed to engage with the transverse bar 207 of the second section 206 of the corner frame member 202. As such, the engagement between the L-shaped prongs 211 of each shelf member 210 and the transverse bars 205, 207 of each corner frame member 202 locks the shelf members 210 in place relative to their respective corner frame members 202.

Figure 27:
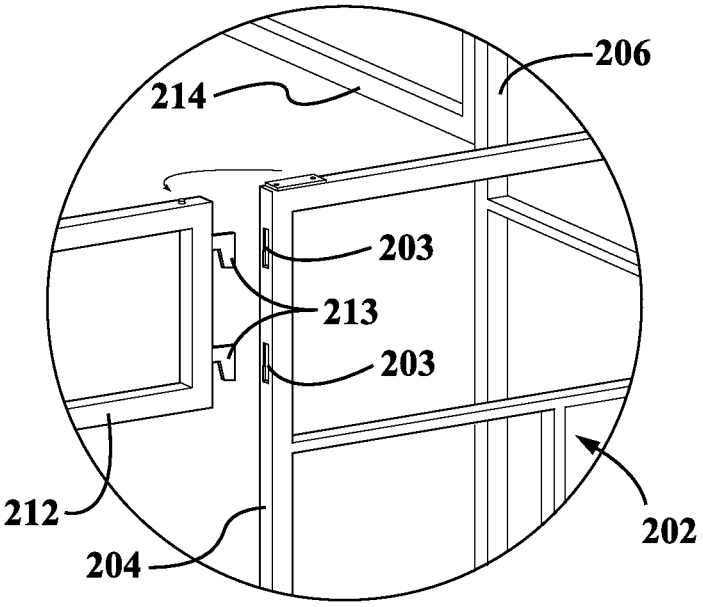
FIG. 27 is an enlarged, partial perspective view of the connection between one of the crossbeam members and one of the folding corner frame members in FIG. 20 (Detail "C"), according to the third and fourth embodiments of the invention.

Referring particularly to FIG. 20, it can be seen that each of the crossbeam members 212, 214 has opposed first and second end portions 212*a*, 212*b* and 214*a*, 214*b*. As best illustrated in FIG. 27, each of the crossbeam members 212, 214 further includes a first pair of hook members 213 extending from a first end portion 212*a* or 214*a* and a second pair of hook members 213 extending from a second end portion 212*b* or 214*b*. Also, as shown in FIGS. 20 and 27, the outer side edges of the first and second sections 204, 206 of each corner frame member 202 are provided with a pair of elongate slots 203 disposed near the top thereof. Each hook member 213 on the crossbeam members 212, 214 engages with a respective slot 203 in a corner frame member 202 (i.e., each hook member 213 is inserted into a respective slot 203) so as to attach the crossbeam members 212, 214 between the corner frame members 202.

Turning to FIGS. 28A and 28B, as briefly described above, a corner insert member 230 is provided at the interior corner of each corner frame member 202 in order to lock its sections 204, 206 in place relative to one another. As shown in the typical details of FIGS. 28A and 28B, each corner insert member 230 includes a top plate 231 with a plurality of tubular members 232 (i.e., two tubular members 232) extending from the bottom surface thereof. Each tubular member 232, which has a generally square-shaped cross-section, is configured to be received within a respective generally square-shaped aperture 228 in the top surface of the corner frame member 202. In addition to fixing the positions of the first and second sections 204, 206 of each corner frame member 202 relative to one another, each of the corner insert members 230 couples a respective one of the connecting members 134 to a respective one of the folding corner frame members 202 without the use of tools. In particular, as shown in FIGS. 28A and 28B, the shaft portion 142 of each connecting member 134 is designed to be inserted into a receiving aperture 234 in the top plate 231 of a respective corner insert member 230. As shown in FIG. 28B, each of the corner insert members 230 is provided with a tubular sleeve 238 disposed next to the tubular members 232 that forms the receiving aperture 234 for the shaft portion 142 of each connecting member 134.

As described above in conjunction with the first embodiment, the shaft portion 142 of each connecting member 134 is provided with a circumferential groove 144 disposed therein. Each of the connecting members 134 is securely coupled a respective one of the corner insert members 230 by means of a tool-less fastener 180 engaging the circumferential groove 144 of the shaft portion 142. That is, a user inserts the fastener 180 into an aperture 237 in the side of the tubular sleeve 238 of the corner insert member 230 (see FIG. 28B), and then, by using the knurled cap of the fastener 180, the user tightens the fastener 180 in the aperture until the distal end portion (opposite the cap) of the fastener 180 engages the circumferential groove 144 in the shaft portion 142 of the connecting member 134. The engagement between the distal end portion of the fastener 180 and the circumferential groove 144 prevents the axial movement of the connecting member 134 relative to the corner insert member 230, thereby securing the connecting member 134 in place.

Now, with reference to FIG. 20, the roof frame members of the portable shelter framing system of the third illustrative embodiment will be described. In general, similar to the first embodiment described above, it can be seen that the roof frame members 218, 220, 222 are circumferentially spaced apart from one another so as to form a supporting structure for a roof material, such as a canvas covering material. An upper end of each of the roof frame members 218, 220, 222 is designed to be inserted into a respective outwardly extending tubular member of the central connecting member 162.

In the third illustrated embodiment, the roof framing members include two (2) middle roof frame members 218 having a first length, two (2) middle roof frame members 220 having a second length, four (4) corner roof frame members 222, and four (4) corner roof frame extension members 224. As shown in FIG. 20, the first length of the middle roof frame members 218 is greater than the second length of the middle roof frame members 220. Like the roof frame extension members 160 described in conjunction with the first embodiment, the corner roof frame extension members 224 are provided with belled end portions so that they are capable of receiving a lower end portion of a respective corner roof frame member 222. That is, the corner roof frame extension members 224 attach to the ends of the corner roof frame members 222, thereby extending their overall length. Also, referring again to FIGS. 20 and 28A, it can be seen that each of the corner roof frame extension members 224 is provided with a collar portion 225 for preventing an axial movement of the roof frame extension member 224 when the roof frame extension member 224 is engaged with the aperture 138 in the body portion 136 of a respective connecting member 132, 134 (see e.g., FIG. 28A for a detailed view of the collar portion 225 on a corner roof frame extension member 224). That is, the collar portion 225 on each roof frame extension member 224 prevents the roof frame extension member 224 from sliding downwardly in the aperture 138. Referring to FIG. 20, it can be seen that the roof frame members 218, 220, 222 are generally similar to the roof frame members 148, 150, 152, except that the middle roof frame members 218, 220 are not provided with upper tubular members for supporting the roof vent covering material 172. Rather, only the four (4) corner roof frame members 222 are provided with upper tubular members for supporting the roof vent covering material 172 (see FIG. 20).

Figure 21:
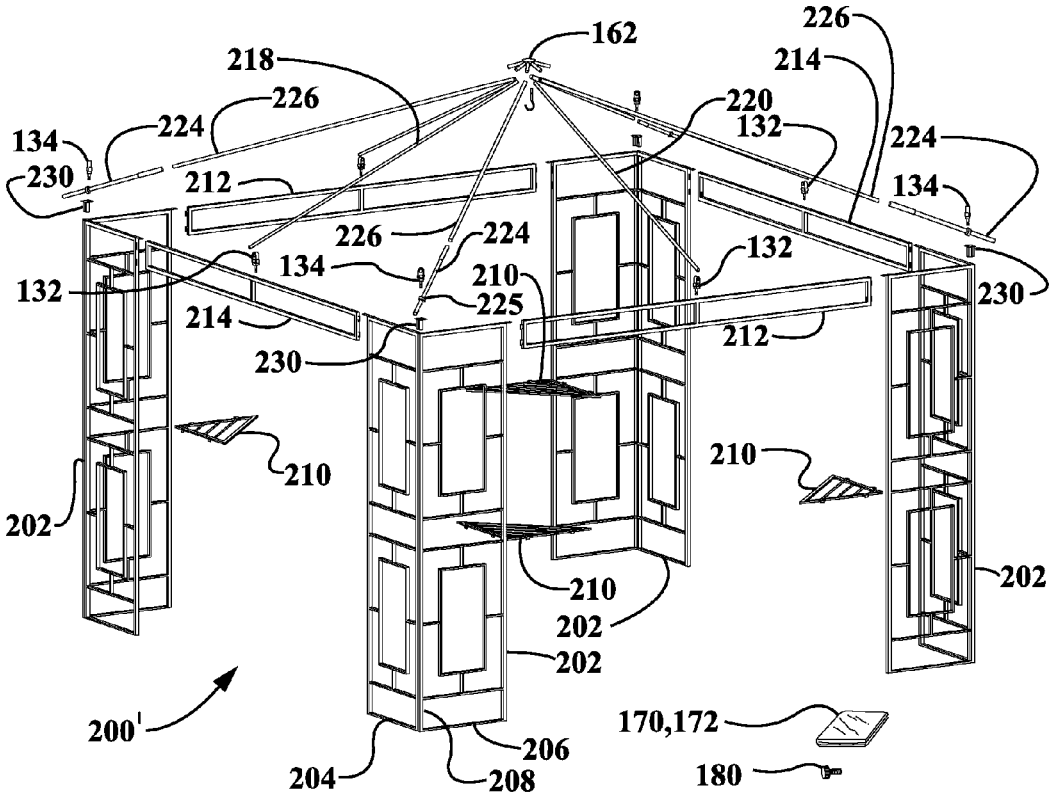
FIG. 21 is an overall exploded perspective view of a portable shelter framing system, according to a fourth embodiment of the invention, wherein the folding corner panel-type portable shelter is not provided with framing for a roof vent.

A fourth exemplary embodiment of the portable shelter or gazebo is seen generally at 200' in FIG. 21. Referring to this figure, it can be seen that, in many respects, the fourth exemplary embodiment is similar to that of the third embodiment. Moreover, many elements are common to both such embodiments. For the sake of brevity, the elements that the fourth embodiment of the portable shelter has in common with the third embodiment will not be discussed because these components have already been explained in detail above. Furthermore, in the interest of clarity, these elements are denoted using the same reference characters that were used in the third embodiment.

In the fourth exemplary embodiment, unlike the third exemplary embodiment, the roof of the portable shelter 200' is not provided with a roof vent. As such, some of the roof framing members of the portable shelter 200' are different from those described above for the third exemplary embodiment. In all other respects, the portable shelter 200' is generally the same as the portable shelter 200.

The roof framing members of the portable shelter 200' will be described with reference to FIG. 21. In this figure, it can be seen that the portable shelter 200' has two (2) middle roof frame members 218 having a first length, two (2) middle roof frame members 220 having a second length, four (4) corner roof frame members 226, and four (4) corner roof frame extension members 224. As shown in FIG. 21, like the third embodiment, the first length of the middle roof frame members 218 is greater than the second length of the middle roof frame members 220. Although, unlike the roof frame members 222 described above in conjunction with the third embodiment, the roof frame members 226 do not contain the upper spaced-apart tubular members that are used to create the roof vent gap in the portable shelter roof. Rather, as illustrated in FIG. 21, each of the roof frame members 218, 220, and 226 comprises a generally linear tubular member that is attached to the central connecting member 162.

Figure 22:
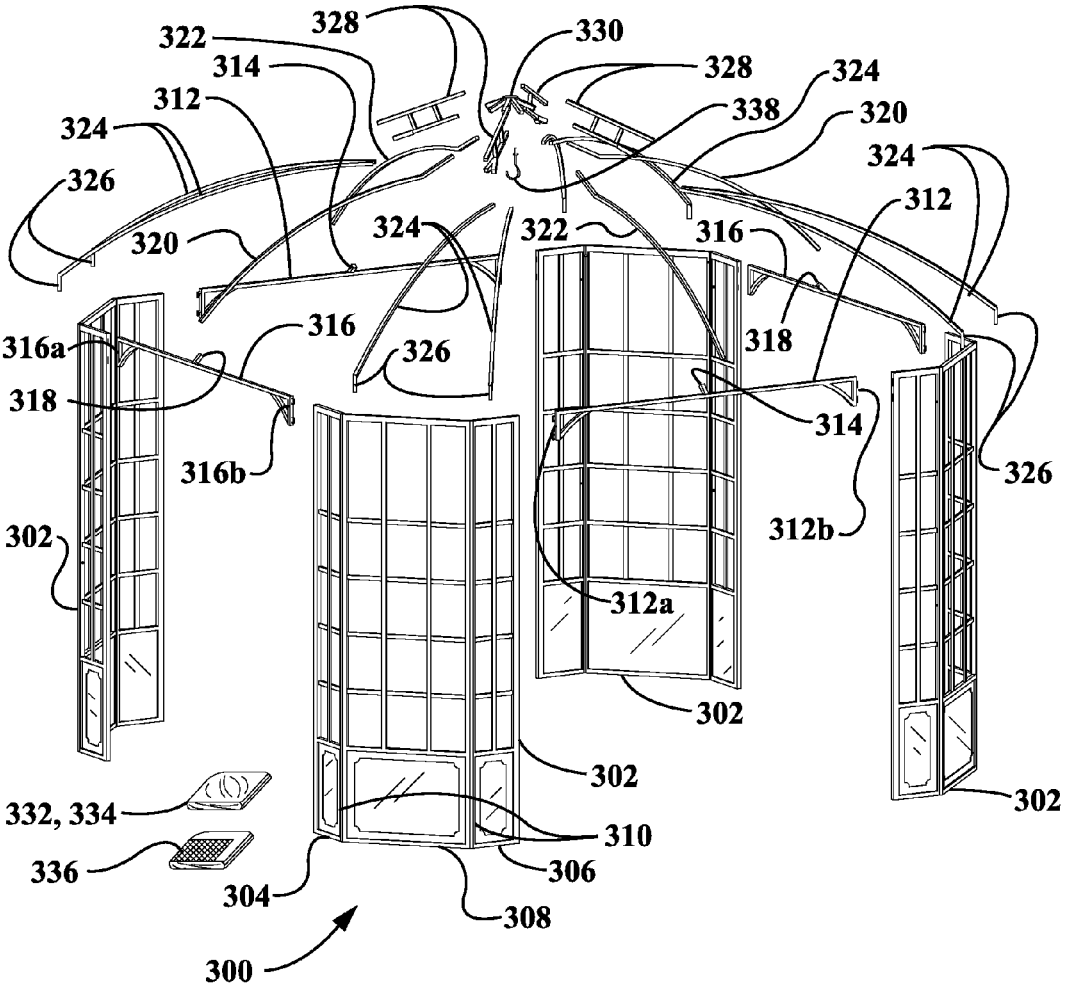
FIG. 22 is an overall exploded perspective view of a portable shelter framing system, according to a fifth embodiment of the invention, wherein a bay window-type portable shelter is provided with framing for a roof vent.

A fifth exemplary embodiment of the portable shelter or gazebo is seen generally at 300 in FIG. 22. Referring to this figure, it can be seen that, in some respects, the fifth exemplary embodiment is similar to that of the preceding four embodiments. In addition, some elements are similar to the previously described embodiments. For the sake of brevity, the elements that the fifth embodiment of the portable shelter has in common with the preceding four embodiments will not be discussed because these components have already been explained in detail above.

In the fifth exemplary embodiment, unlike the previously described embodiments, the vertical support members are in the form of folding bay window corner assemblies 302, rather than corner post members 102 or folding corner frame members 202. Also, in the fifth embodiment, the crossbeam members 312, 316 have a different structure than that which was described above for the preceding embodiments. In the fifth embodiment, the roof frame members 320, 322, 324 connect to the vertical support members 302 and the crossbeam members 312, 316 in a different manner than that which was explained above for the first four embodiments. Finally, the structures of the roof frame members 320-324 differ from those described in conjunction with the preceding four embodiments.

In FIG. 22, it can be seen that the vertical support members of the portable shelter framing system of the fifth illustrated embodiment are in the form of folding bay window corner assemblies 302 (or folding corner frame members 302). With reference to this figure, it can be seen that each folding bay window corner assembly 302 includes a center section 308, a first folding section 304 pivotally coupled to the center section 308, a second folding section 306 pivotally coupled to the center section 308, one or more first hinge members 310 pivotally coupling the first folding section 304 to the center section 308, and one or more second hinge members 310 pivotally coupling the second folding section 306 to the center section 308. The first folding section 304 of the folding bay window corner assembly 302 can be rotated in a counter-clockwise direction relative to the center section 308 of the folding bay window corner assembly 302 until the first folding section 304 is completely unfolded. Similarly, the second folding section 306 of the folding bay window corner assembly 302 can be rotated in a clockwise direction relative to the center section 308 of the folding bay window corner assembly 302 until the second folding section 306 is completely unfolded. During the unfolding of the folding bay window corner assembly 302, the first and second folding sections 304, 306 each rotate about a respective pivotal axis disposed through the hinge members 210 until the first and second folding sections 304, 306 have been rotated approximately 135 degrees relative to the center section 308, and the folding bay window corner assembly 302 is completely unfolded.

Referring again to FIG. 22, it can be seen that each of the crossbeam members 312, 316 has opposed first and second end portions 312*a*, 312*b* and 316*a*, 316*b*. As shown in FIG. 22, similar to the third and fourth embodiments, each of the crossbeam members 312, 316 further includes a first pair of hook members extending from a first end portion 312*a* or 316*a* and a second pair of hook members extending from a second end portion 312*b* or 316*b*. Also, like the third and fourth embodiments, the outer side edges of the first and second folding sections 304, 306 of each folding bay window corner assembly 302 are provided with a pair of elongate slots disposed near the top thereof. Each hook member on the crossbeam members 312, 316 engages with a respective slot in a folding bay window corner assembly 302 (i.e., each hook member is inserted into a respective slot) so as to attach the crossbeam members 312, 316 between the folding bay window corner assemblies 302. As shown in FIG. 22, the structure of the crossbeam members 312, 316 is different from the crossbeam members described in conjunction with the preceding embodiments. In particular, each crossbeam member 312, 316 is provided with a center tubular portion bounded by triangular-shaped end portions with the hook members disposed thereon. Also, each of the crossbeam members 312 is provided with a centrally located, diagonally extending roof member connector 314, while each of the crossbeam members 316 is provided with a centrally located, diagonally extending roof member connector 318.

Now, with reference again to FIG. 22, the roof frame members of the portable shelter framing system of the fifth illustrative embodiment will be described. In general, similar to the embodiments described above, it can be seen that the roof frame members 320, 322, 324 are circumferentially spaced apart from one another so as to form a supporting structure for a roof material, such as a canvas covering material. An upper end of each the roof frame members 320, 322, 324 is designed to be coupled to an outwardly extending tubular member of a central connecting member 330, either directly or indirectly by means of a slanting arched beam connecting member 328. As shown in FIG. 22, each connecting member 328 has branched tubular portions, which are designed to engage with upper end portions of respective corner roof arched beam members 324 (i.e., the upper end portion of each corner beam member 324 is inserted into a respective branched tubular portion of a connecting member 328. The upper tubular member of each connecting member 328, which is spaced apart from the lower tubular member thereof by two (2) generally vertical tubular members, supports the roof vent cover 334 of the portable shelter 300.

In the fifth illustrated embodiment, the roof framing members include two (2) middle roof frame members 320 having a first length, two (2) middle roof frame members 322 having a second length, eight (8) corner roof frame members 324, and four (4) slanting arched beam connecting members 328 for connecting respective pairs of corner roof frame members 324 together. As shown in FIG. 22, the first length of the middle roof frame members 320 is greater than the second length of the middle roof frame members 322. Each of the corner roof frame members 324 is provided with downturned lower end portions 326 that are configured to be received within respective apertures in the top of each folding bay window corner assembly 302 (i.e., each downturned end portion 326 is inserted into an aperture near an outer side edge of the center section 308 of the folding bay window corner assembly 302, proximate to the locations where the first and second folding sections 304, 306 are hingedly connected to the center section 308). The lower end portions of the middle roof frame members 320 engage with the diagonally extending roof member connectors 318 (i.e., the lower end portions of the middle roof frame members 320 are inserted into diagonally extending roof member connectors 318), while the lower end portions of the middle roof frame members 322 engage with the diagonally extending roof member connectors 314 (i.e., the lower end portions of the middle roof frame members 322 are inserted into diagonally extending roof member connectors 314).

Turning again to FIG. 22, the exterior coverings and other features of the portable shelter 300 will now be described. Similar to that described above in conjunction with the first embodiment, a peripheral roof canopy portion 332 is configured to cover a majority of the roof framing system, while a central roof canopy portion 334 is configured to be disposed over the upper tubular members of the connecting members 328 that form the roof vent of the portable shelter 300. Together the peripheral roof canopy portion 332 and the central roof canopy portion 334 form the roof of the portable shelter 300. In FIG. 22, it can be seen that the underside of the central connecting member 330 is provided with a hook member 338 attached thereto (e.g., the end portion of the hook member 338 may be provided with a plurality of external threads that matingly engage with a plurality of internal threads on the central connecting member 330). The hook member 338 may be used for the same purposes described above for the first embodiment. The sides of the portable shelter 300 are configured to be covered with netted side curtain panels 336 that are designed to permit airflow therethrough, yet keep insects from entering the interior of the portable shelter 300.

Figure 23:
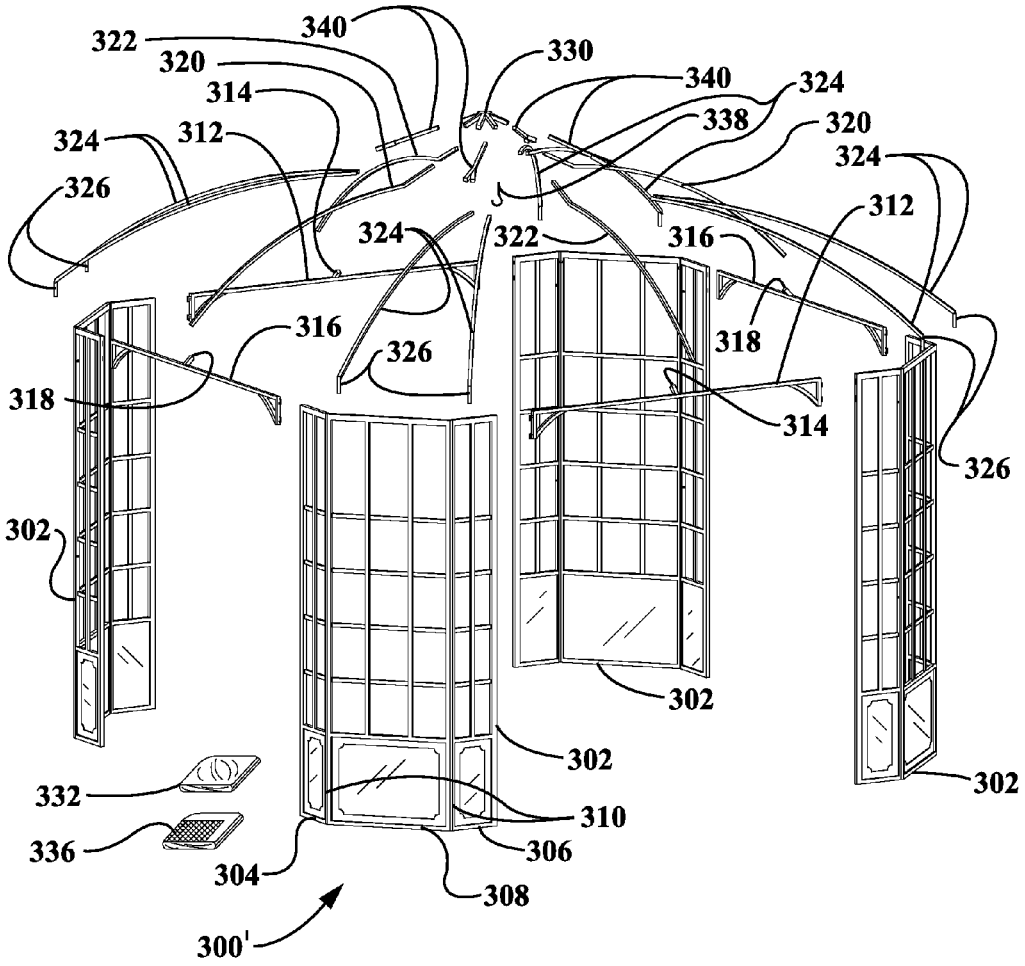
FIG. 23 is an overall exploded perspective view of a portable shelter framing system, according to a sixth embodiment of the invention, wherein the bay window-type portable shelter is not provided with framing for a roof vent.

A sixth exemplary embodiment of the portable shelter or gazebo is seen generally at 300' in FIG. 23. Referring to this figure, it can be seen that, in many respects, the sixth exemplary embodiment is similar to that of the fifth embodiment. Moreover, many elements are common to both such embodiments. For the sake of brevity, the elements that the sixth embodiment of the portable shelter has in common with the fifth embodiment will not be discussed because these components have already been explained in detail above. Furthermore, in the interest of clarity, these elements are denoted using the same reference characters that were used in the fifth embodiment.

In the sixth exemplary embodiment, unlike the fifth exemplary embodiment, the roof of the portable shelter 300' is not provided with a roof vent. As such, some of the roof framing members of the portable shelter 300' are different from those described above for the fifth exemplary embodiment. In all other respects, portable shelter 300' is generally the same as the portable shelter 300.

The roof framing members of the portable shelter 300' will be described with reference to FIG. 23. In this figure, it can be seen that the portable shelter 300' has two (2) middle roof frame members 320 having a first length, two (2) middle roof frame members 322 having a second length, eight (8) corner roof frame members 324, and four (4) slanting arched beam connecting members 340 for connecting respective pairs of corner roof frame members 324 together. As shown in FIG. 23, the first length of the middle roof frame members 320 is greater than the second length of the middle roof frame members 322. Although, unlike the slanting arched beam connecting members 328 described above in conjunction with the fifth embodiment, the slanting arched beam connecting members 340 do not contain the upper spaced-apart tubular members that are used to create the roof vent gap in the portable shelter roof. Rather, as illustrated in FIG. 23, each of the slanting arched beam connecting members 340 merely comprises a generally Y-shaped connecting member that is designed to couple the upper ends of a pair of corner roof frame members 324 to an outwardly extending tubular member of a central connecting member 330.

Figure 24:
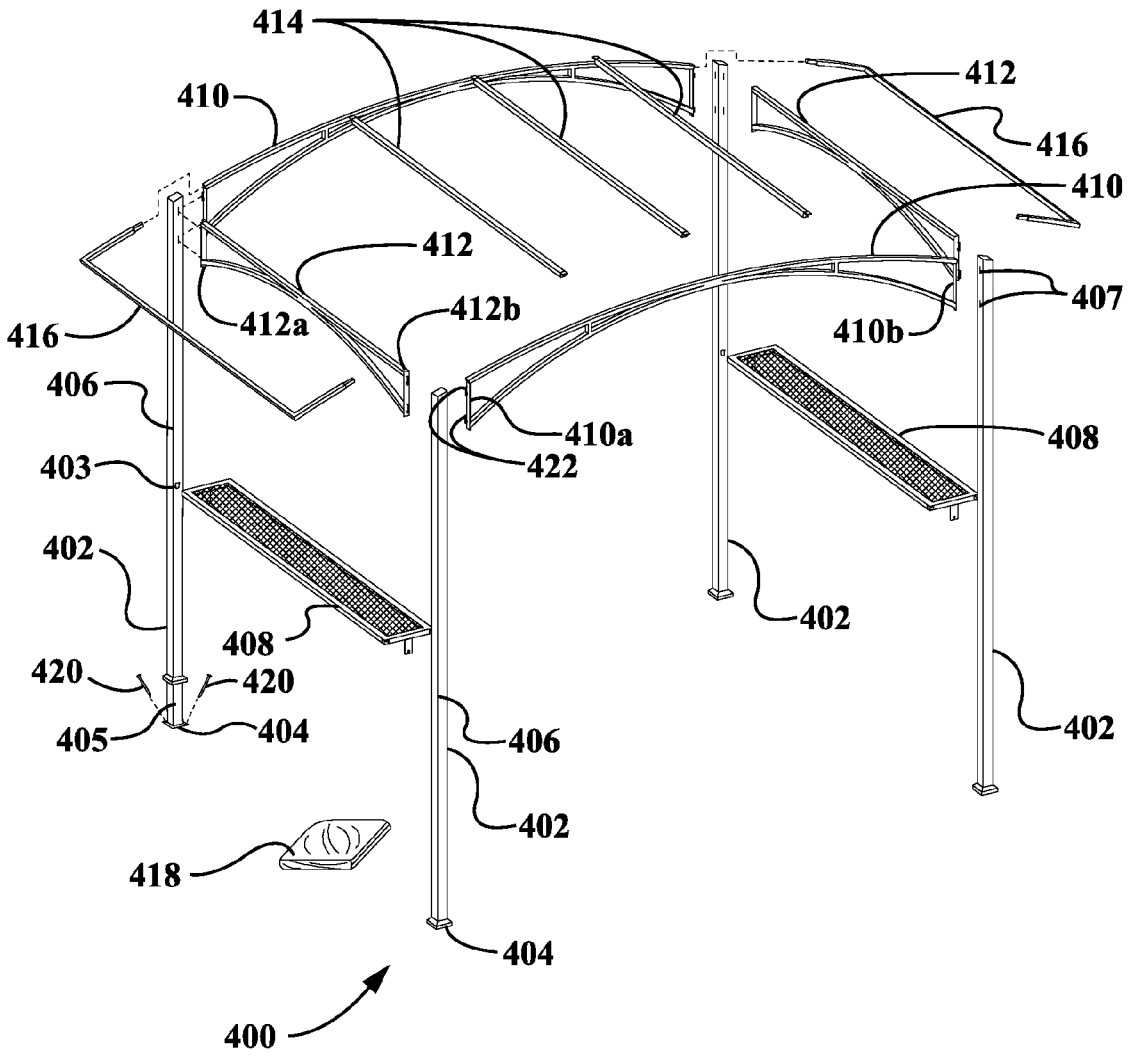
FIG. 24 is an overall exploded perspective view of a portable shelter framing system for a grill-type portable shelter, according to a seventh embodiment of the invention.

A seventh exemplary embodiment of the portable shelter or gazebo is seen generally at 400 in FIG. 24, wherein the portable shelter is in the form of a grill-type gazebo. Referring to this figure, it can be seen that, in some respects, the seventh exemplary embodiment is similar to that of the preceding six embodiments. Although, most elements of the portable shelter 400 are different from those of the preceding embodiments described herein.

As shown in FIG. 24, similar to the first embodiment, the vertical support members of the portable shelter framing system of the seventh illustrated embodiment are in the form of corner post members 402. Each corner post member 402 includes a base portion 404, a tubular body portion 406, and two pairs of elongate slots 407 that are disposed proximate to the end of the tubular body portion 406 (e.g., the top end), which is opposite to the end having the base portion 404 (e.g., the bottom end). As will be described hereinafter, each pair of elongate slots 407 is configured to engage with a corresponding pair of hook members 422 on an end of one of the crossbeam members 410, 412. The pairs of elongate slots 407 are oriented generally perpendicular to one another (i.e., on adjacent sides of the tubular body portion 406 of the corner post member 402).

As shown in FIG. 24, a generally rectangular-shaped, transverse shelf member 408 is configured to be attached between a pair of corner post members 402 on each end of the portable shelter 400. Each of the corner post members 402 is provided with an aperture 403 in a side thereof for accommodating a projection on the end of the transverse shelf member 408, or a fastener for securing the transverse shelf member 408 to the corner post member 402. In FIG. 24, it can be seen that the apertures 403 are approximately disposed in the middle of each of the corner post members 402.

Referring particularly to FIG. 24, it can be seen that each of the crossbeam members 410, 412 has opposed first and second end portions 410*a*, 410*b* and 412*a*, 412*b*. Each of the crossbeam members 410, 412 further includes a first pair of hook members 422 extending from a first end portion 410*a* or 412*a* and a second pair of hook members 422 extending from a second end portion 410*b* or 412*b*. Each hook member 422 on the crossbeam members 410, 412 engages with a respective elongate slot 407 in a corner post member 402 (i.e., each hook member 422 is inserted into a respective slot 407) so as to attach the crossbeam members 410, 412 between the corner post members 402.

Now, with reference again to FIG. 24, the roof frame members of the portable shelter framing system of the seventh illustrative embodiment will be described. The roof framing members of the portable shelter 400 include three (3) transverse roof frame members 414 and two (2) C-shaped side roof frame members 416. The transverse roof frame members 414 each engage with, and are disposed between, the crossbeam members 410. As diagrammatically represented by the dashed line in FIG. 24, end portions of the C-shaped side roof frame members 416 are inserted into receiving apertures in the ends of the crossbeam members 410. The end portions of each C-shaped side roof frame member 416 have a reduced cross-sectional area, as compared to the remainder of the C-shaped side roof frame member 416, in order to allow their insertion into the ends of the crossbeam members 410. The transverse roof frame members 414, together with the C-shaped side roof frame members 416, support the roof canopy 418 of the grill-type portable shelter or gazebo 400.

In order to securely attach the portable shelter 400 to the ground, the base portion 404 of each corner post members 402 can be provided with a plurality of apertures disposed therethrough for receiving ground spikes 420 that can be driven into the ground. Also, as illustrated in FIG. 24, at least one of the corner post members 402 can be provided with an adjustable telescoping portion 405 so as to allow the length of the corner post member 402 to be adjusted for accommodating uneven ground surfaces.

It is readily apparent that the aforedescribed portable shelters 100, 100', 200, 200', 300, 300', 400 offer numerous advantages. First, each of the portable shelters 100, 100', 200, 200', 300, 300', 400 incorporate a framing system that can be quickly and easily assembled and disassembled each time that it is used. Secondly, each of the portable shelters 100, 100', 200, 200', 300, 300', 400 utilize a portable shelter framing system that is capable of being assembled and disassembled without the use of any tools. Finally, each of the portable shelters 100, 100', 200, 200', 300, 300', 400 described herein employ a portable shelter framing system that is capable of being disassembled into a plurality of compact components that do not occupy a large amount of space when the portable shelter is transported and stored.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A portable shelter framing system comprising, in combination:

a plurality of vertical support members;

a plurality of crossbeam members, each of said crossbeam members configured to be connected between a pair of said plurality of vertical support members without the use of tools;

a plurality of roof frame members, each of said roof frame members configured to be coupled to one of said plurality of vertical support members or one of said plurality of crossbeam members without the use of tools; and a plurality of connecting members, each of said connecting members configured to couple a respective one of said plurality of roof frame members to a respective one of said plurality of vertical support members or to a respective one of said plurality of crossbeam members without the use of tools, and each of said plurality of connecting members including a body portion having an aperture disposed therethrough and a shaft portion connected to said body portion, said aperture of said body portion configured to receive said respective one of said plurality of roof frame members therein, and said shaft portion configured to be inserted into a receiving aperture in said respective one of said plurality of vertical support members or said respective one of said plurality of crossbeam members.

2. The portable shelter framing system according to claim 1, wherein each of said plurality of vertical support members is in the form of a corner post member or a folding corner frame member.

3. The portable shelter framing system according to claim 1, wherein each of said plurality of crossbeam members is configured to be folded approximately in half.

4. The portable shelter framing system according to claim 1, wherein each of said plurality of crossbeam members has opposed first and second end portions; and wherein each of said plurality of vertical support members has a pair of channel members oriented generally perpendicular to one another, each of said pair of channel members configured to receive a respective said first or second end portion of one of said plurality of crossbeam members.

5. The portable shelter framing system according to claim 4, wherein each of said plurality of crossbeam members further includes a first aperture provided in said first end portion and a second aperture provided in said second end portion;

wherein each of said pair of channel members on each said vertical support member further includes an aperture that is configured to substantially align with one of said first and second apertures on a respective said crossbeam member when said crossbeam member and said vertical support member are engaged with one another; and wherein each of said first and second end portions of each said crossbeam member is configured to be secured to one of said pair of channel members on said vertical support member by means of a respective fastener passing through a respective one of said first and second apertures of said crossbeam member and a respective said aperture of said channel member without the use of tools.

6. The portable shelter framing system according to claim 1, wherein each of said plurality of crossbeam members has opposed first and second end portions with one or more hook members;

wherein each of said plurality of vertical support members has outer side edges with one or more respective slots disposed therein; and wherein each of said one or more hook members is configured to engage with a respective one of said one or more slots in one of said outer side edges of said vertical support member.

7. The portable shelter framing system according to claim 1, wherein said shaft portion of each of said plurality of connecting members includes a circumferential groove, each of said plurality of connecting members configured to be securely coupled to one of said plurality of vertical support members or to one of said plurality of crossbeam members by means of a tool-less fastener engaging said circumferential groove of said shaft portion.

8. The portable shelter framing system according to claim 1, wherein each of said plurality of vertical support members is in the form of a folding corner frame member; and wherein said portable shelter framing system further comprises a plurality of corner insert members, each of said plurality of corner insert members configured to couple a respective one of said plurality of connecting members to a respective one of said plurality of folding corner frame members without the use of tools.

9. The portable shelter framing system according to claim 1, further comprising a central connecting member having a plurality of outwardly extending tubular members, each of said plurality of roof frame members configured to engage with a respective one of said plurality of outwardly extending tubular members of said central connecting member.

10. The portable shelter framing system according to claim 1, wherein said plurality of roof frame members includes one or more corner roof frame members comprising a pair of generally parallel, spaced apart tubular members, said pair of tubular members being connected to one another by one or more intersecting tubular members that are disposed generally perpendicular thereto.

11. The portable shelter framing system according to claim 1, further comprising one or more roof frame connecting members having branched tubular portions, at least some of said plurality of roof frame members configured to engage with a respective one of said branched tubular portions of said one or more roof frame connecting members.

12. The portable shelter framing system according to claim 1, wherein each of said plurality of vertical support members is in the form of a folding corner frame member; and wherein some of said plurality of roof frame members have downturned end portions that are configured to be received within respective apertures in said folding corner frame members.

13. The portable shelter framing system according to claim 1, wherein each of said plurality of crossbeam members includes a diagonally extending tubular connecting member, each of said diagonally extending tubular connecting members configured to engage a respective one of said plurality of roof frame members.

14. A portable shelter framing system comprising, in combination:

a plurality of vertical support members, each of said plurality of vertical support members being in the form of a corner post member;

a plurality of crossbeam members, each of said crossbeam members configured to be connected between a pair of said plurality of vertical support members without the use of tools;

a plurality of roof frame members, each of said roof frame members configured to be circumferentially spaced apart from one another so as to form a supporting structure for a roof material; and a plurality of connecting members, each of said connecting members configured to couple a respective one of said plurality of roof frame members to a respective one of said plurality of vertical support members or to a respective one of said plurality of crossbeam members without the use of tools, each of said plurality of connecting members including a body portion having an aperture disposed therethrough and a shaft portion connected to said body portion, said aperture of said body portion configured to receive said respective one of said plurality of roof frame members therein, and said shaft portion configured to be inserted into a receiving aperture in said respective one of said plurality of vertical support members or said respective one of said plurality of crossbeam members.

15. The portable shelter framing system according to claim 14, wherein each of said plurality of vertical support members is provided with a tubular sleeve disposed therein that forms said receiving aperture for said shaft portion of said connecting member.

16. The portable shelter framing system according to claim 14, wherein at least some of said plurality of roof frame members are provided with a collar portion for preventing an axial movement of said roof frame member when said roof frame member is engaged with said aperture in said body portion of a respective said connecting member.

17. A portable shelter framing system comprising, in combination:

a plurality of vertical support members, each of said plurality of vertical support members having a pair of channel members oriented generally perpendicular to one another;

a plurality of folding crossbeam members, each of said plurality of folding crossbeam members configured to be folded approximately in half, and each of said folding crossbeam members configured to be connected between a pair of said plurality of vertical support members without the use of tools, each of said plurality of folding crossbeam members having opposed first and second end portions, each of said plurality of folding crossbeam members including a pair of spaced-apart longitudinal frame members connected to one another at said first and second end portions by respective first and second vertically-extending frame members, each of said pair of channel members of said plurality of vertical support members configured to receive a respective said first or second vertically-extending frame member of one of said plurality of folding crossbeam members, each of said plurality of folding crossbeam members further including a first aperture provided in said first vertically-extending frame member and a second aperture provided in said second vertically-extending frame member, each of said pair of channel members on each said vertical support member further including an aperture that is configured to substantially align with one of said first and second apertures on a respective said folding crossbeam member when said folding crossbeam member and said vertical support member are engaged with one another, and wherein each of said first and second vertically-extending frame members of each said folding crossbeam member is configured to be secured to one of said pair of channel members on said vertical support member by means of a respective fastener passing through a respective one of said first and second apertures of said folding crossbeam member and a respective said aperture of said channel member without the use of tools; and a plurality of roof frame members, each of said roof frame members configured to be coupled to one of said plurality of vertical support members or one of said plurality of folding crossbeam members without the use of tools.

18. The portable shelter framing system according to claim 1, wherein said aperture disposed in said body portion of each of said plurality of connecting members has an opening diameter that is larger than an outer diameter of said shaft portion of each of said plurality of connecting members.

19. The portable shelter framing system according to claim 14, wherein said aperture disposed in said body portion of each of said plurality of connecting members has an opening diameter that is larger than an outer diameter of said shaft portion of each of said plurality of connecting members.

20. The portable shelter framing system according to claim 17, further comprising a plurality of connecting members, each of said connecting members configured to couple a respective one of said plurality of roof frame members to a respective one of said plurality of vertical support members or to a respective one of said plurality of crossbeam members without the use of tools.

* * * * *